US012276174B2

(12) United States Patent
Malave

(10) Patent No.: US 12,276,174 B2
(45) Date of Patent: Apr. 15, 2025

(54) PACKER SYSTEM, AND PROCESS TO SETTLE AND RETRIEVE

(71) Applicant: JP INTERNATIONAL BUSINESS LLC, Weston, FL (US)

(72) Inventor: Jesus Malave, El Tigre (VE)

(73) Assignee: JP INTERNATIONAL BUSINESS LLC, Weston, FL (US)

( * ) Notice: Subject to any disclaimer, the term of this patent is extended or adjusted under 35 U.S.C. 154(b) by 0 days.

(21) Appl. No.: 18/275,865

(22) PCT Filed: Jan. 27, 2022

(86) PCT No.: PCT/US2022/013967
§ 371 (c)(1),
(2) Date: Aug. 4, 2023

(87) PCT Pub. No.: WO2022/169655
PCT Pub. Date: Aug. 11, 2022

(65) Prior Publication Data

US 2024/0060387 A1 Feb. 22, 2024

Related U.S. Application Data

(60) Provisional application No. 63/145,671, filed on Feb. 4, 2021.

(51) Int. Cl.
*E21B 33/126* (2006.01)
*E21B 23/06* (2006.01)
(Continued)

(52) U.S. Cl.
CPC ..... *E21B 33/1265* (2013.01); *E21B 23/06* (2013.01); *E21B 31/00* (2013.01);
(Continued)

(58) Field of Classification Search
CPC .... E21B 33/1265; E21B 47/117; E21B 23/06; E21B 31/00; E21B 33/062; E21B 33/1285; E21B 43/128
See application file for complete search history.

(56) References Cited

U.S. PATENT DOCUMENTS 4,637,468 A 1/1987 Derrick
4,924,941 A 5/1990 Farley
(Continued)

OTHER PUBLICATIONS

International Search Report and Written Opinion received in International Application No. PCT/US2022/13967, mailed on Jun. 6, 2022, 21 Pages.

(Continued)

*Primary Examiner* — Dany E Akakpo
(74) *Attorney, Agent, or Firm* — Gearhart Law, LLC

(57) ABSTRACT

The invention consists a packer system for use in well. In particular, the invention deals with a packer itself, a settling device, to settle said packer, and a retriever device, to recover said packer, it also comprises the process of operation corresponding to said system. Also comprises a process to settle with a settle device and a process to retrieve, with a retriever device, that can be used in settle and recovery processes, for delayed production of wells and the reduction of costs associated with the replacement of progressive cavity pumps (PCP).

19 Claims, 15 Drawing Sheets

(51) Int. Cl.

| | |
|---|---|
| ***E21B 31/00*** | (2006.01) |
| ***E21B 33/06*** | (2006.01) |
| ***E21B 33/128*** | (2006.01) |
| ***E21B 43/12*** | (2006.01) |
| ***E21B 47/117*** | (2012.01) |

(52) U.S. Cl.
CPC ..... *E21B 33/062* (2013.01); *E21B 33/1285* (2013.01); *E21B 43/128* (2013.01); *E21B 47/117* (2020.05)

(56) References Cited

U.S. PATENT DOCUMENTS

| | | | | |
|---|---|---|---|---|
| 4,930,573 | A | 6/1990 | Lane et al. | |
| 2011/0127030 | A1 | 6/2011 | Clark et al. | |
| 2012/0160475 | A1 | 6/2012 | Burgos | |
| 2013/0206392 | A1 | 8/2013 | Sherman | |
| 2015/0260001 | A1 | 9/2015 | Kuo et al. | |
| 2015/0260008 | A1* | 9/2015 | McCoy | E21B 33/134 166/138 |
| 2016/0123104 | A1* | 5/2016 | Harris | E21B 33/1216 166/138 |
| 2018/0305994 | A1 | 10/2018 | Ford | |

OTHER PUBLICATIONS

International Preliminary report received in International Application No. PCT/US2022/13967, mailed on Jun. 6, 2022, 17 Pages.

* cited by examiner

PACKER SYSTEM, AND PROCESS TO SETTLE AND RETRIEVE

CROSS REFERENCE TO RELATED APPLICATION

The present application is a U.S. national phase application of a PCT Application No. PCT/US2022/013967 filed on Jan. 27, 2022, which claims a priority to US Provisional Patent Application No. 63/145,671 filed in US on Feb. 4, 2021 a disclosure of which are incorporated in their entireties by reference herein.

BACKGROUND OF THE INVENTION

Field of the Invention

The present invention relates to a packer system for use in well. In particular, the invention deals with a packer itself, this is a packer unit, a settling device, to settle said packer unit, and a retriever device, to recover said packer unit it also comprises the process of operation corresponding to said system. Process to settle and process to recover said packer unit is also discloses.

This invention refers to packers that can be used in recovery processes for the deferred production of wells and the costs reduction associated with the replacement of progressive cavity pumps (PCP) and mechanical pumps (MP).

The main goal of this invention is to convert a pipe production system into an insertable production system, maintaining production levels while reducing operating times and operative costs.

DESCRIPTION OF RELATED ART

The artificial lift and/or secondary recovery process include the use of different elements that are used in conjunction with the Progressive Cavity or Mechanical Pumping production pumps, such as: capillaries, heating cables, bottom sensors, iron straps, clamps, etc. that make the recovery or extraction of well production systems complex, whether by means of Progressive Cavity Pumps (PCP) or Mechanical Pumps (MP)

The average useful life of the production pump is around 365 days of continuous operation, however, the rest of the components of the well completion such as; capillaries, heating cables, bottom sensors, iron straps, clamps, etc. have a longer useful life, but must be removed earlier, in order to replace the well production pump.

The main types of progressive cavity pumps (PCP) are:

Tubular pumps that are lowered with the tubing, forming an integral part of the well production tubing string, therefore for their replacement it is necessary to pull-out the production tubing, with its bottom accessories, such as, capillaries, beating cables, sensors bottom, iron straps, clamps, etc. This operation is carried out with drills with a capacity greater than 350 Hp, and lower it with the same or similar equipment.

Insertable pumps which are lowered with rods string inside the production pipe of the well, for their replacement does not require pull out the production pipe, however, they require that the completion of the well contains a landing nipple where the pump can be landed, this type, of production reduces the area open to flow from the well.

A common problem is when it becomes necessary to replace a PCP pipe production system, after reaching its useful life. Then is necessary to pull the production pipe from the well with all its components, change the PCP pump and running in the production pipe again with all its accessories and new pump, an operation that takes place in approximately 5 to 6 days, which entails strapping the pipe again, stapling the capillary cable and/or heating cable one by one, and measuring the electrical continuity of the cables, among others, which implies risks in the integrity of secondary components due to the complexity of their handling on site.

However, in the proposed system a part of the used pump, the stator, remains at the bottom, with all the bottom accessories, capillary cables and heater cables without affecting its operation, a new pump is placed on top of the damaged pump stator inside the production pipe, which sits without problems inside or from the production pipe without the need to pull the pipe, with the use mainly of the proposed Packer unit and a small services unit (below 150 Hp of power), and a rods string, in just 2 days of operation, achieving savings in time, operating cost and production delivery 4 days less than normal operating time.

The present invention makes it possible to use a pipe-type crude extraction pump as if it were an insert-type extraction pump, it allows changing the use of a conventional pumping system to an insertable system, with all advantages that this action provides, without affecting the flow area of the well, with which no solution is known in the state of the art that allows using a pipe pump inside a production pipe, eliminating the risk involved in the pull/extraction of the production pipe from the well, Bottom accessories, capillaries and heater cables.

Another desirable effect in the state of the art consists of achieving a settlement based on the mechanical displacement of the settlement system by the action of hydraulic pressure, which pushes a system of inverted cups, and reaches the internal mechanical path of the system, to achieve anchoring of the shutter internally to the production pipe of the well, differing from what is known for being actuated without production pipe and with the use of rods string.

The back-spin effect, or backward effect, is reflected when for some reason, a sudden stop occurs and the accumulated energy is released in the reverse way in the form of torque. This effect is undesirable in well operation and requires of tools to control it.

Another desirable effect in the state of the art would be to achieve the installation of tubular PCP with Flush By equipment and its settlement at any depth within the production pipe as it does not depend on a landing nipple.

The state-of-the-art reports multiple packers' technologies, among which are the following, as the closest to the technology proposed by the present invention.

For example, U.S. Pat. No. 8,082,085 to Clark & Wilson discloses methods and apparatuses for anchoring progressing cavity pumps (PCP). In one embodiment, a method of anchoring a PCP to a rods string disposed in a wellbore which includes acts of inserting the PCP and anchor assembly into the rods. Running the PCP and anchor assembly through the tubular to any first longitudinal location along the rods string. Longitudinally and rotationally coupling the PCP and the anchor assembly to the tubular and forming a seal between the PCP and the rods string at the first location and performing a downhole operation in the tubular.

In another example, WO 2017 0163051 to Guillena shows a hydraulic anchoring assembly for anchoring and sealing an insertable progressing cavity pump on rods in a well, the anchoring assembly comprising: an inner mandrel connected downstream of and in fluidic communication with the insertable progressing cavity pump; an inflatable packer connected to the mandrel by shareable means, the inflatable packer being inflated by increasing pressure of fluids within the inner mandrel above an inflate pressure to seal the inner mandrel to the well; a one-way inflation valve in fluidic communication with the inflatable packer to maintain inflation of the inflatable packer, a hydraulic slip means connected to the inner mandrel by shareable means, the hydraulic slip being activated by further increasing pressure of fluids within the inner mandrel above a slip deployment pressure for gripping the well to resist longitudinal and rotational movement of the inner mandrel in the well; a one-way deployment valve in fluidic communication with the hydraulic slip to maintain deployment of the hydraulic slip; and a sealing means for sealing the inner mandrel downstream of the hydraulic slip means, the sealing means being releasable to allow fluid to flow through the inner mandrel to the insertable progressing cavity pump; wherein the inflate pressure is below the slip deployment pressure.

In yet another example, U.S. Pat. No. 9,689,243 to Morrow, discloses a system to isolate the PCP pump rotor from the drive rods string without the need for a complicated linkage between the thrust bearing and the pump rotor. The system also utilizes a thrust bearing that does not need to be isolated from the produced fluids, nor provided with clean lubrication.

None of the known techniques report to use a pipe-type crude extraction pump as if it were an insert-type extraction pump, it allowing change the use of a conventional pumping system to an insertable system.

Neither do they mention or suggest techniques that allow accelerating the recovery of deferred production from wells and the reduction of costs associated with PCP and MP replacement works.

Additionally, the cited state of the art does not report settlement based on the mechanical displacement of the settlement system by the action of hydraulic pressure, which pushes a system of inverted cups, and reaches the internal mechanical path of the system, to achieve the anchoring of the shutter internally to the production pipe, unlike what is known to be operated without production pipe and with the use of a rods string.

And, none of those cited mentions or suggests a packer system that comprises a packer as such, a settling device, and a retriever device, to integrate a packer system.

In this sense, the techniques described above are not oriented in the same sense as what the present invention proposes, so that even when they are in the same technological sector, they could not be taken as interfering with the patentability of what the present invention proposes.

SUMMARY OF THE INVENTION

The present invention proposes to overcome the problems mentioned above, this is possible by connecting the upper part of the PCP to the lower connector of the packer unit and its fixing capacity on the internal walls of the production pipe, at the desired depth. In a general way, this is achieved without affecting the flow area of the well, allowing to use a pipe pump inside a production pipe, eliminating the risk involved to pull/extraction of the production pipe from the well, downhole fittings, capillaries and heating cables.

Another objective is achieving a settlement based on the mechanical displacement of the settlement system by the action of hydraulic pressure, which pushes a system of Inverted cups, and reaches the internal mechanical displacement of the system, to achieve anchoring of the shutter internally to the production pipe of the well, differing from what is known for being actuated without production pipe and with the use of rods string.

Other objective is to prevent the backspin effect in well production and use of additional tools to control it.

One of the most benefits is accelerating the recovery of production deferred wells and decreased costs associated with the work of replacement of PCP and MP.

BHA is an abbreviation for bottom hole assembly, BIA in the context of the proposed invention refers to the bottom assembly for installation of the packer unit by means of the setting device, production of the well and uninstallation of the same with the retriever device. The BHA refers to the different components that are run in into the well from the first component lowered into the well to before the rods string.

BOP is an abbreviation for Blowout preventer, that is a specialized valve, used to seal, control and monitor oil and gas wells to prevent blowouts, the uncontrolled release of crude oil or natural gas from a well. BOP's Rams or simply Ram BOP is one of the types of BOP, also known as an associated object of a Blowout Preventer that is generally mounted on the top of a BOP stack. The function for a Ram BOP is very much similar to how a gate valve works with only difference that a Ran BOP uses Rams which are usually the pair of opposing steel plungers.

These steel plungers are rubber faced that come together with great force and seals the wellbore to control the back pressure kicks.

Flush By unit, is a low-capacity equipment (150 hp) that is designed to carry out light work in oil wells, clean and circulate wells blocked by sand or mud, replace pumps, remove and/or insert rods string, fishing rods string, replace heads, in fast deployment, rig-up, operation and rig down of the equipment.

PCP is an abbreviation for "Progressive Cavity Pump," is a type of a positive displacement pump which uses a rotor to pump fluids. As the rotor of this pump rotates, it transfers the fluid forward through the pump in the sequence of small fixed shape discrete cavities. This results in making volumetric flow rate proportional to the rotational rate of the rotor because of which fluid is pumped with low shear.

MP is an abbreviation for "Mechanical Pump". It is a reciprocating piston pump that is used to mechanically lift the liquid from the well when there is not enough pressure in the reservoir for the liquid to flow to the surface by itself as it does in upwelling wells.

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or process steps.

The word "preferably" means that the declared option is taken as priority, but is not the only one choice, so another option could be used without it being considered that this affects the scope of what is claimed.

The word "packer" in a device context is equivalent to "packer unit", or "packer itself", and means the Packer as a device, with all those their elements, and doesn't is equivalent to the packer system of which is a component, as being also it the settling device and retriever device, other components of said packer system.

According to the operative orientation of the components of the invention, it is considered by relative orientation, that by up, or upper it is understood that area furthest from the well, while down or lower it is related to the area closest to said well.

This invention also discloses a process for settle and a process for pull out the packer unit Pull out means recover the packer unit.

Other objects, features and advantages of the present invention will become apparent from the following figure, and detailed description. It should be understood, however, that the figures, detailed description, and examples, while indicating specific embodiments of the invention, are given by way of illustration only and are not meant to be limiting.

On the other hand, it is contemplated that changes and modifications within the spirit and scope of the invention will become apparent to those skilled in the art at this detailed description.

BRIEF DESCRIPTION OF THE FIGURES

This invention advantages may become apparent to those skilled in the technique with the benefit of the following detailed description and upon reference to the accompanying drawings.

FIG. 7. is about to a representation of the packer with the settling device arranged on.

DESCRIPTION OF THE INVENTION

Figure 1A:
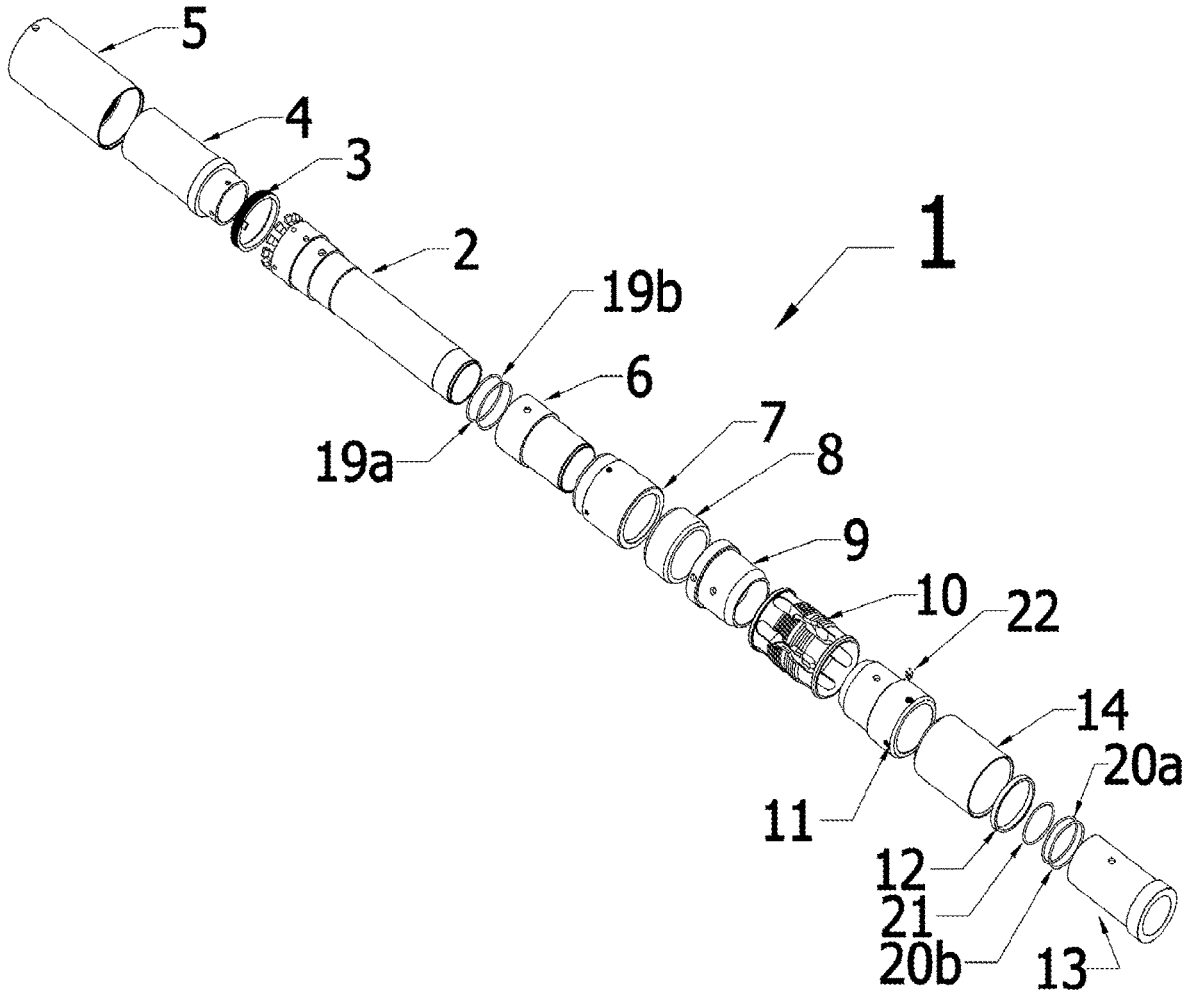
FIG. 1A shows the packer assembly.

The present invention provides a solution to problems associated mainly to convert a tubing production system into an insertable production system, maintaining production levels while reducing operating times and cost.

In a general embodiment, this invention comprises a packer system that includes a packer unit, a setting device to settle said packer unit, and a retriever device to pull out said packer unit. This invention also discloses a process to settle said packer unit, and a process to recover said packer unit.

Then, this invention comprises three mainly devices; A Packer unit, a settle device and a retriever device, to pull out said packer unit.

The most elements have circular cross sect on, they are basically cylindric, so often uses radial to refers to any geometric characteristic referred.

In order to know each component of the preferred embodiments, each one of them will be described in detail with support from the FIGS. 1A to 15.

A. Packer.

In one general embodiment, this invention comprises a packer unit 1 that shows at FIGS. 1A, 1B, 2A, 2B, 2C, 2D and 2E. Said packer unit 1 comprising; a first mandrel 2, a safety ring 3, a release connection element 4, an upper safety retainer 5, a seal holder 6, a lower safety retainer 7, a sealing element 8, an upper compression element 9, an anchor element, a lower compression element 11, an anti-friction ring 12, an anti-friction retainer 13, a lower connector 14, a first security pins; 15*a*, 15*b*, 15*c*, a second security pins: 16*s*, 16*b*, 16*c*, a first breakout pins, 17*a*, 17*b*, 17C, 17*d*, a second breakout pins 18*a*, 18*b*, O-rings seals; 19*a*, 19*b*, 20*a*. 20*b*, 21, and Allen stud 22, where said preferred allen stud is an allen stud ½" NC.

In a preferred and alternative embodiment of the invention, the number of Allen studs may be greater in number than one in the assembly. In accordance with FIG. 1C, an arrangement of three in number of studs allen, 22*a*, 22*b*, and 22C can be employed. In any case, the number of allen studs to be used will depend on the operating conditions, and can be selected from the range of at least one to a maximum of six. The selection will be based on the weight and tension needs of the tool. As in the general modality, allen studs can preferably be allen studs NC ½"

Figure 2A:
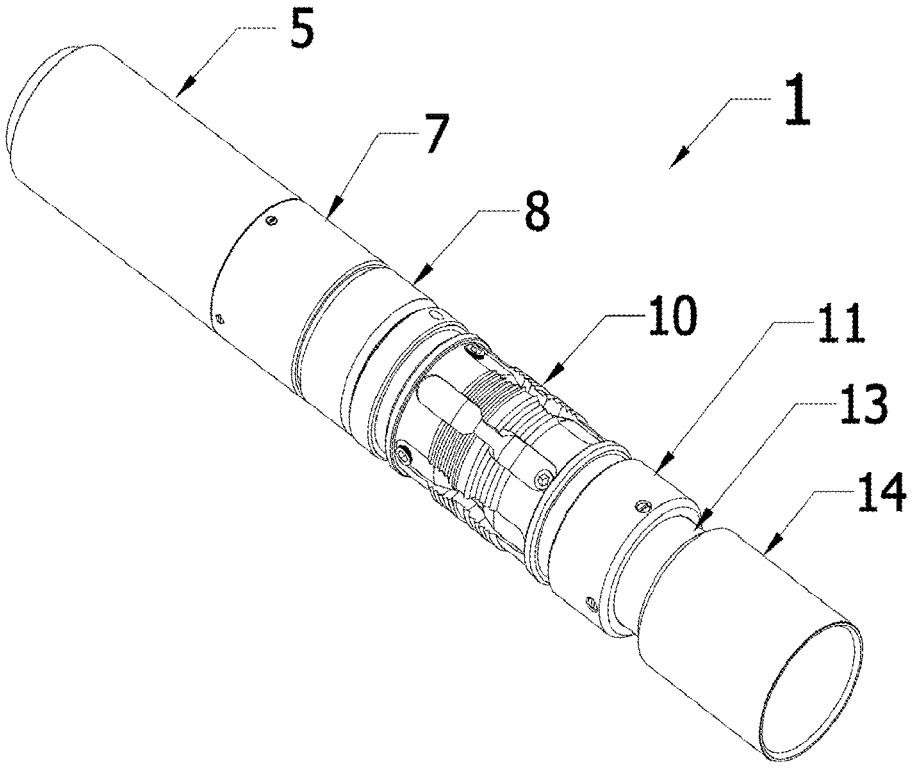
FIG. 2A is about the packer as a whole.
Figure 2B:
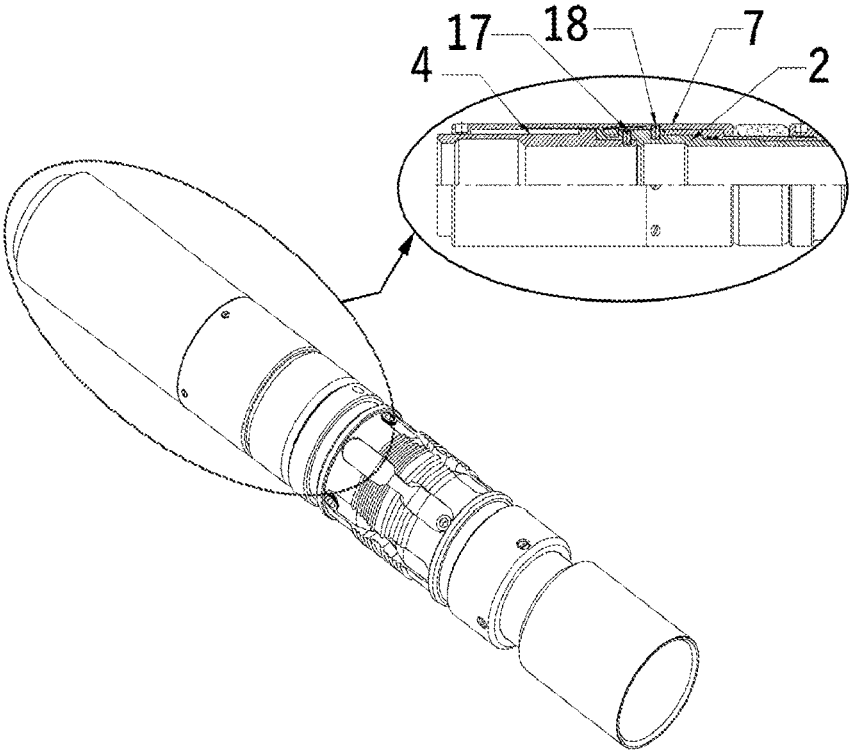
FIG. 2B. is about a longitudinal partial cross section detail of packer that how shows breakout pins disposed between the first mandrel, the release connection element and the lower safety retainer.

The number 17 used at FIG. 2B represent whatever pin selected from said first breakout pins; 17*a*, 17*b*, 17*c*, 17*d*.

Figure 1B:
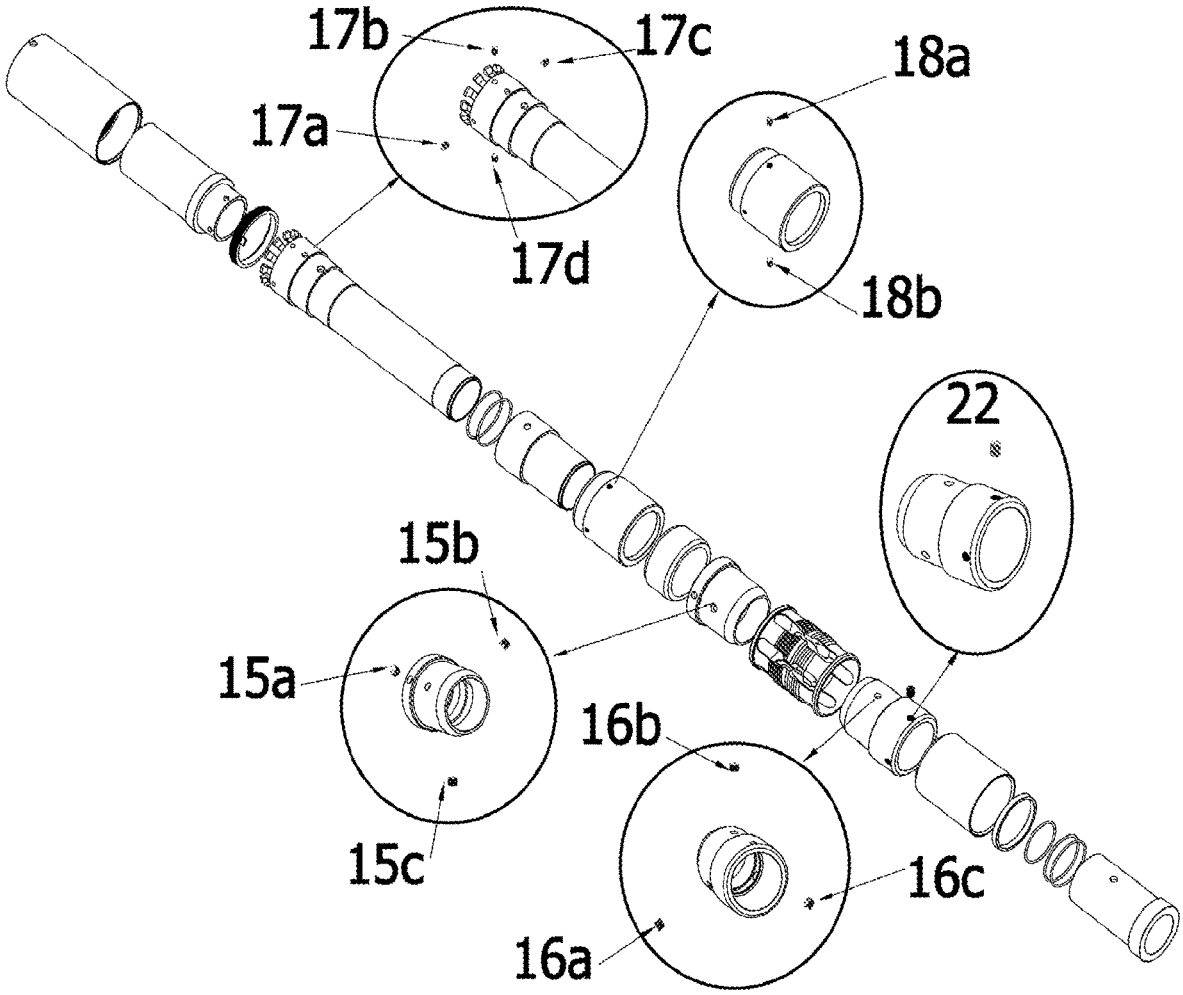
FIG. 1B shows details about set pins radial distribution.
Figure 1C:
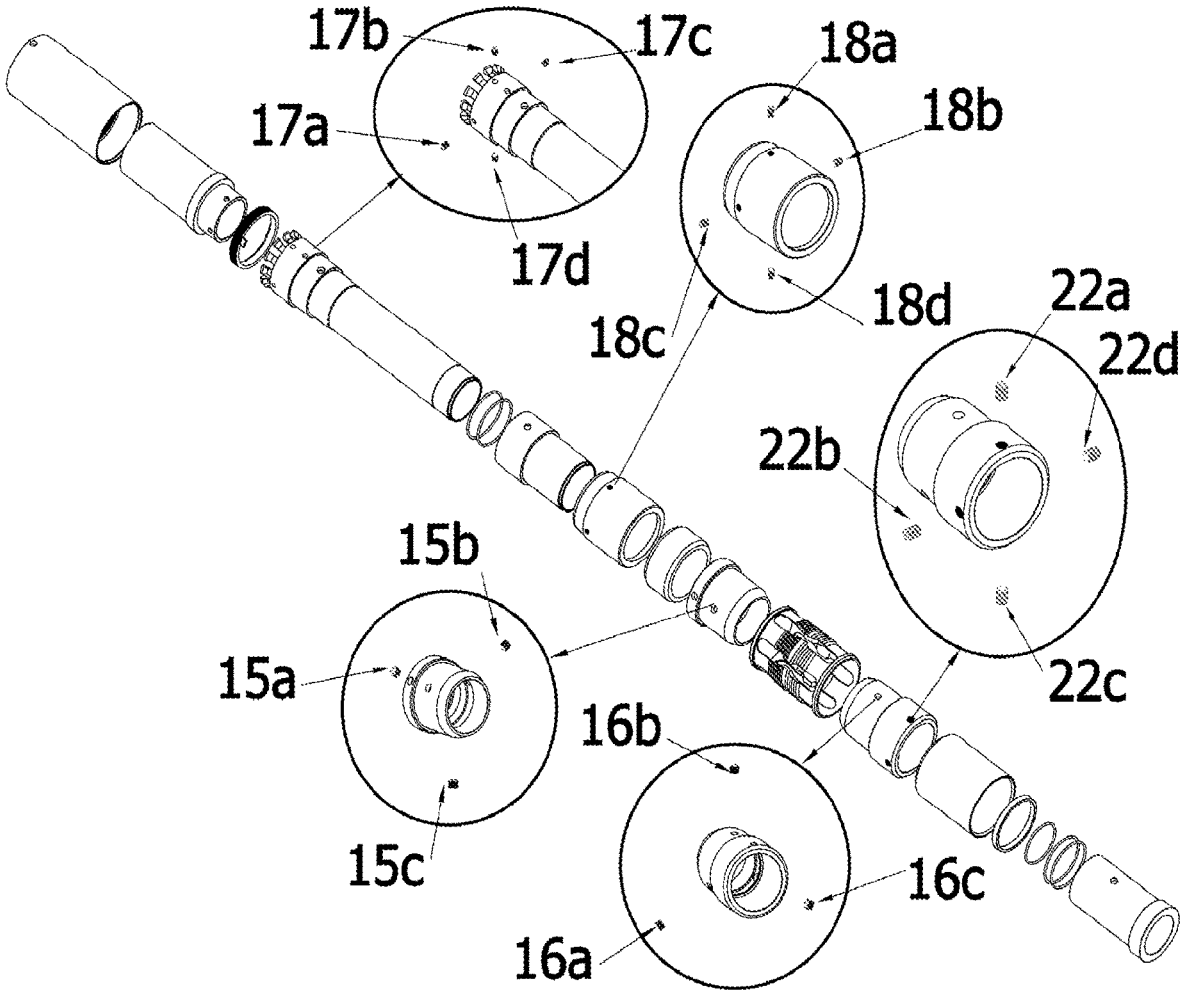
FIG. 1C. Discloses spatial details regarding the radial pin distribution according to preferred embodiments of the invention.

The number 18 used at FIG. 2B represent whatever pin selected from said second breakout pins 18*a*, 18*b*, not limited to this embodiment, it can also represent any of the second alternative breakout pins defined in FIG. 1C, or in the range declared in reference.

In a preferred and alternative embodiment of the invention, there is a set of second break pins, in accordance with those that can be seen illustratively in FIG. 1C, identified as 18*a*, 18*b*, 18*c*, and 18*d*, in in this case, four in quantity, although operationally there may be a number of at least one, and a maximum of eight, depending on the operating conditions that require it. Thus, the number of pins to be used for second breakout pins can be selected from the range of at least one to a maximum of eight. The selection will be based on the depth of the well and the required settling pressures.

Figure 2C:
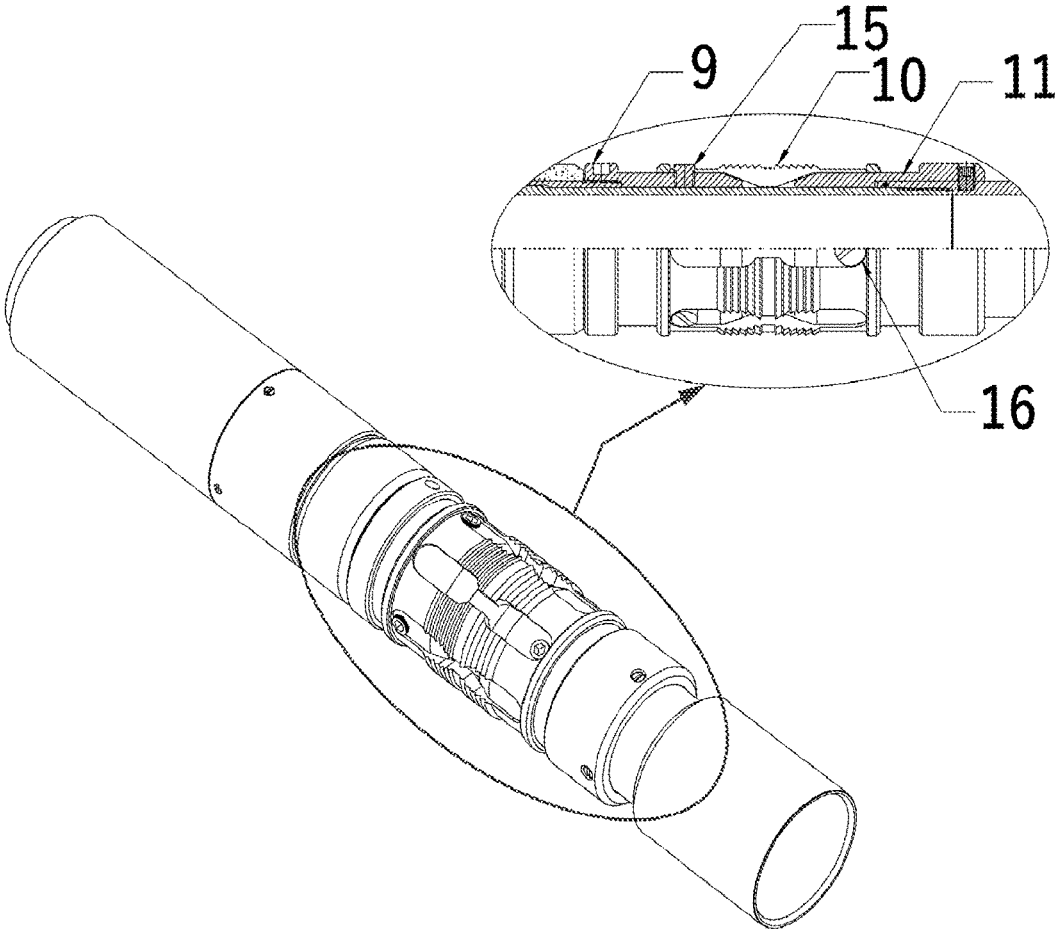
FIG. 2C. is about a longitudinal partial cross section detail of packer that how shows security pins disposed between the upper compression element, the anchor element, and the lower compression element.
Figure 2D:
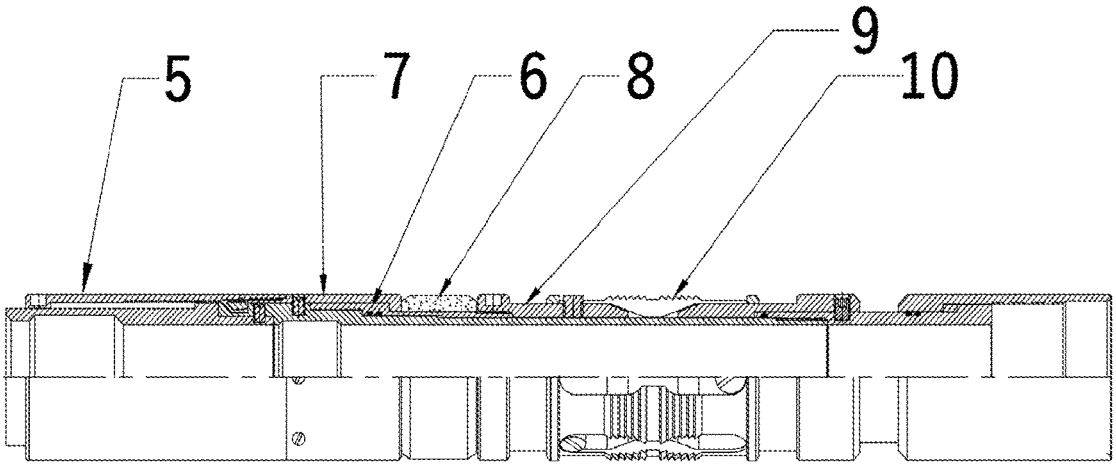
FIG. 2D is about a longitudinal cross section of the packer shows its mainly elements.
Figure 2E:
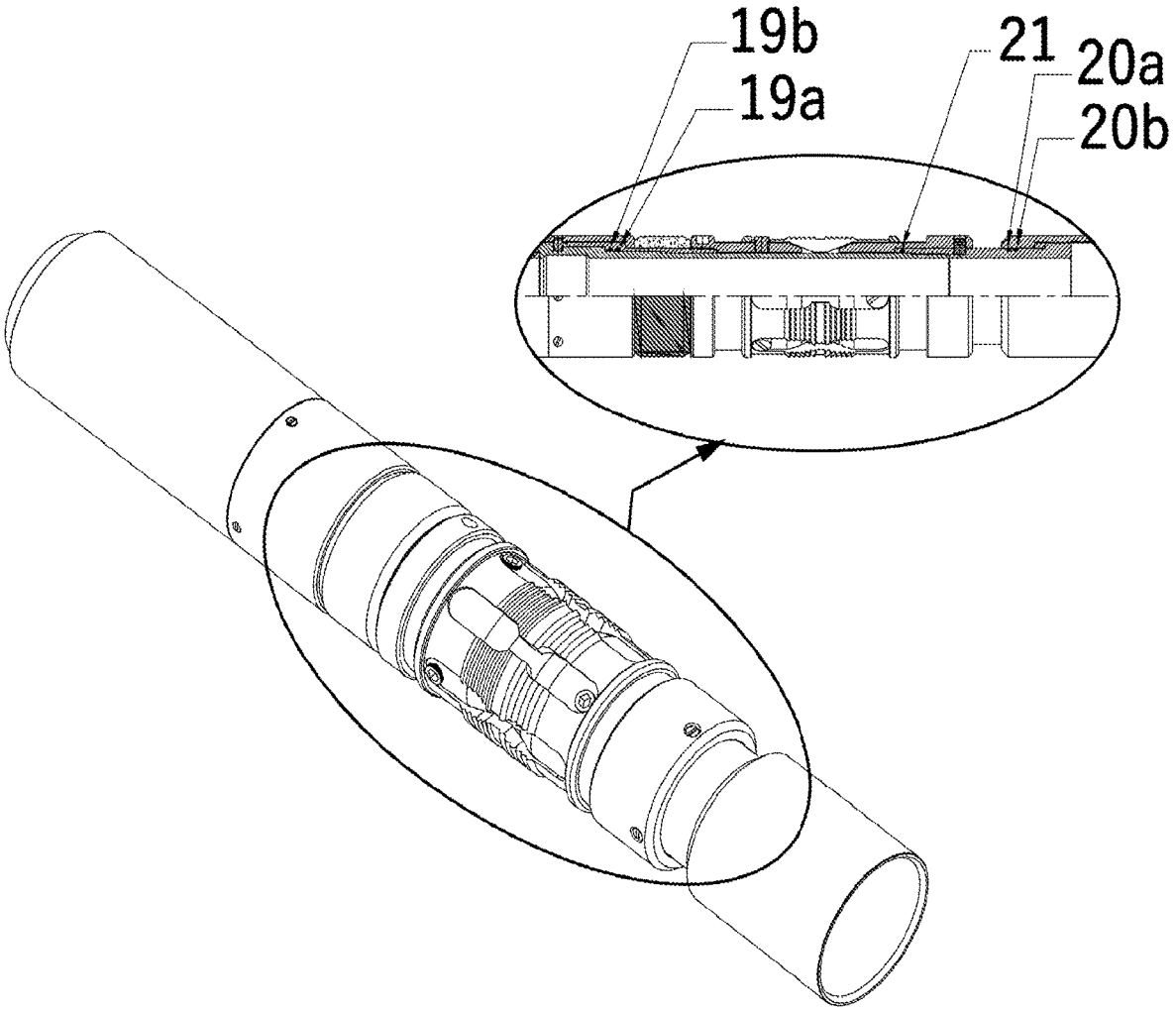
FIG. 2E is about a longitudinal partial cross section detail of packer that shows each O-ring are disposed.

The number 15 used at FIG. 2C represent whatever pin selected from first security pins; 15*a*, 15*b*, 15*c*.

The number 16 represent at FIG. 2C represent whatever pin from said second security pins; 16*a*, 16*b*, 16*c*.

Each cited packer unit element has a specific function within the packer unit assembly 1, where for each case it is specified below:

The first mandrel 2 provides internal support to the packer unit, in particular to follows packer unit 1 elements; sealing element 8, seal holder 6, lower safety retainer 7, compression elements 9, 11, upper and lower respectively, and anchor element 10. The first mandrel 2 can be made of any of the following materials SAE/AISI 1030, 1035, 1040, 1045, 1050, 1000, 1095, 4130, 4140, 4340, preferably AISI-4140. The first mandrel 2 has a head upper located, and an elongated body lower located. Oriented from down to up, the head comprises three radial surface regions, a first radial surface region defined by a diameter higher than the elongated body and proximate to it, the corner at the lower end proximate to the elongate body defines a stop to use operative, said first radial surface region has a continuous diameter without holes. A second radial surface region next up to said first radial surface region and with a diameter higher than it, said second surface region comprises a single blind hole to use with installation auxiliary pin that is located nearest to said first radial surface region. And a third radial surface region next up to said second surface region, that has four blind holes located nearest to said second radial surface region, each one spaced 90° between them, at the other end the third radial surface has a radial toothed section, designed to facilitate install coupling, that radial toothed section comprising teeth's with protections shape, intermediate between radial toothed section and the blind holes the third radial surface region comprises four through holes, to insert alternatively the first breakout pins 17*a*, 17*b*, 17*c*, 17*d* that's it with 90° between each one, and finally between the near teeth and the respective through hole has a radial groove to insert the safety ring 3. Internally at the head has a reduced diameter region to form a bump stoper. The elongated body has external thread to joint to anti-friction retainer 13.

The safety ring 3 keeps the anchoring system and the sealing element 8 fixed, guaranteeing the hermetic seal in the production pipeline. The anchoring system comprises; the anchor element 10, and the compression elements 9, 11, upper and lower respectively. The safety ring 3 is made preferably from AISI-4140 material, alternatively being able to be manufactured from any of the following selected steels, SAE/AISI 1030, 1035, 1040, 1045, 1050, 1060, 1095, 4130, 4340. The safety ring is to insert at the first mandrel radial groove. The safety ring 3 has an external thread to joint to upper safety retainer, but this is a special joint, formed by the configuration of both complementary threads so this safety ring 3 has a thread similar to that of upper safety retainer 5, but opposite, to allow unidirectional movement, only downwards, to activate settling and sealing mechanism, this mechanism comprises; sealing element 8, compression elements 9, 11, upper and lower respectively, and anchoring element 10, and is activated by the action of the hydraulic pressure exerted, and gives the anchoring element sufficient force to stay anchored to the walls of the production pipeline, to grant it a safety function in the system, as it prevents unwanted unscrewing in the opposite direction when manipulating the packer system, particularly in post-settlement tasks.

Figure 6A:
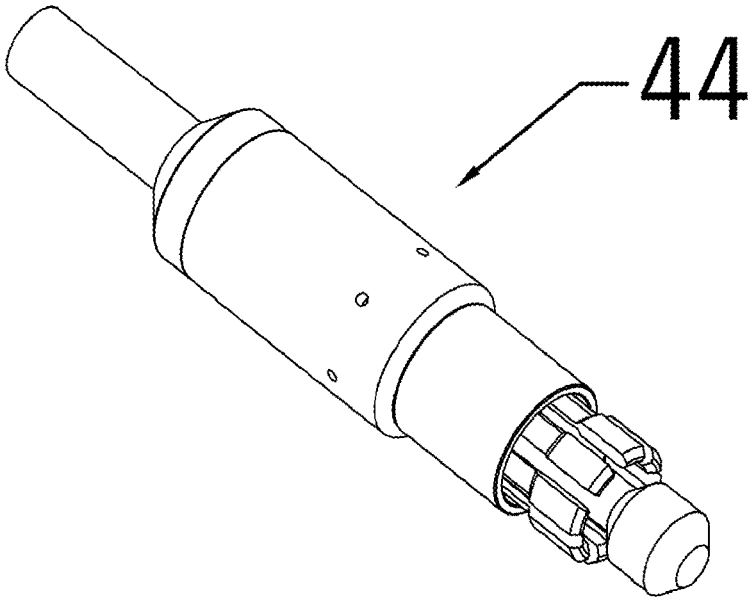
FIG. 6A. shows retriever device as a whole.
Figure 6B:
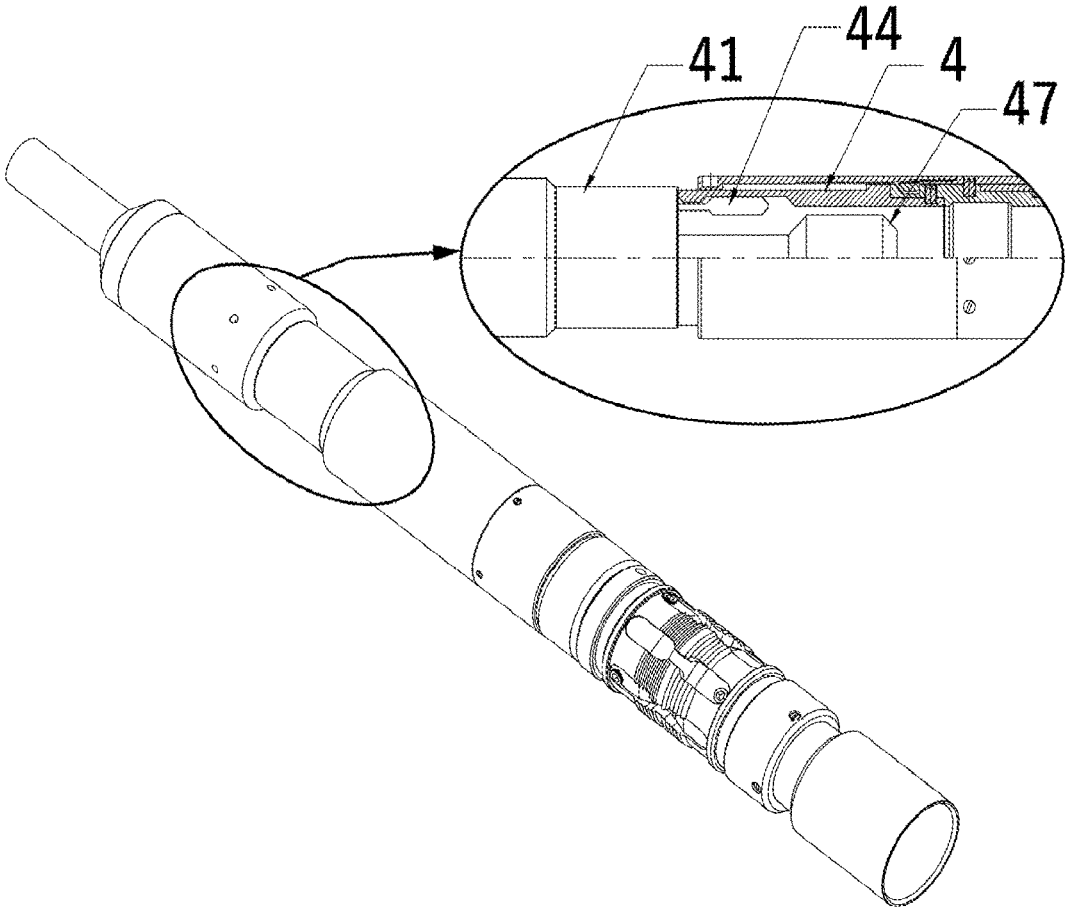
FIG. 6B. is about a longitudinal partial cross section detail of retriever device and to packer coupling.
Figure 7:
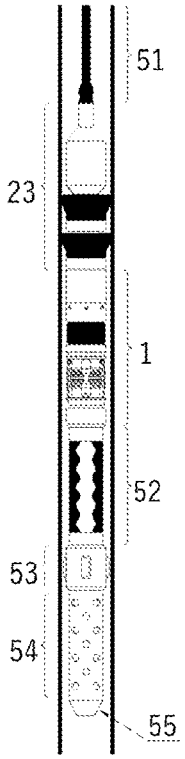
Figure 8:
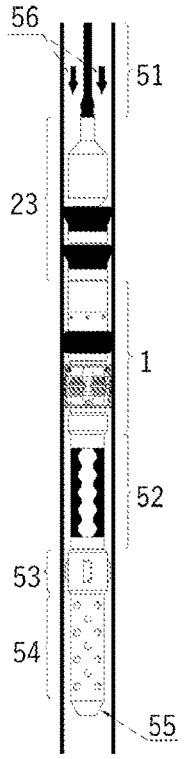
FIG. 8 shows the system being filled with fluid, which is the hydraulic activation of the system.
Figure 9:
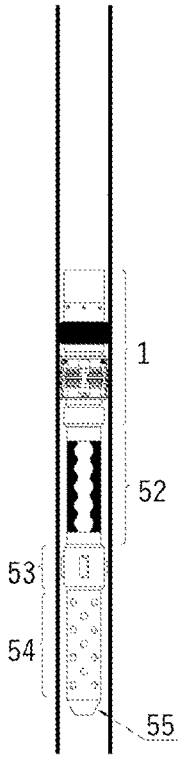
FIG. 9. is about to the packer already seated and where the settling device has been removed.
Figure 10:
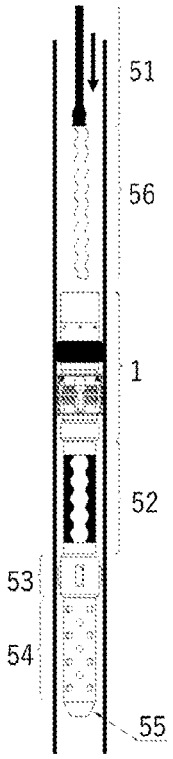
FIG. 10. shows the installation on the packer of the PCP rotor connected to the rods string arranged.
Figure 11:
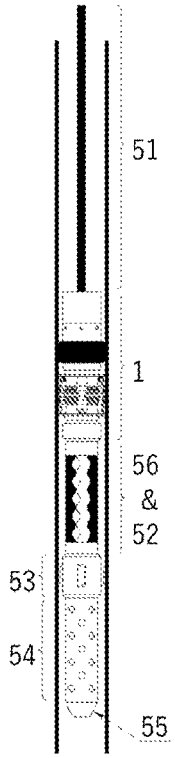
FIG. 11. is about to the packer operating normally at the production tubing.
Figure 12:
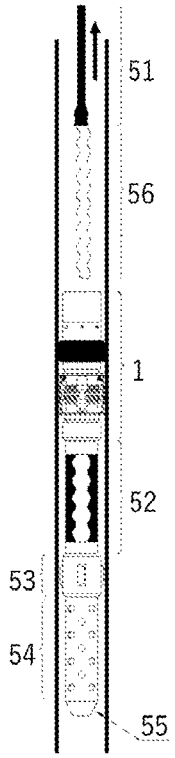
FIG. 12. shows the removal of the PCP rotor by means of the rods string.
Figure 13:
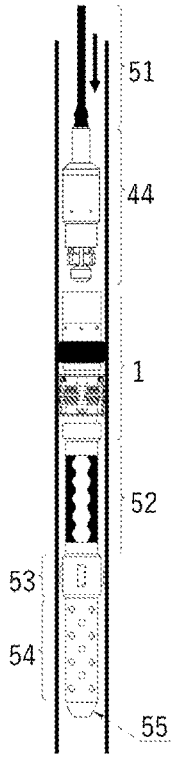
FIG. 13. is about to disposition of the retriever device activated by Lie rods string.
Figure 14:
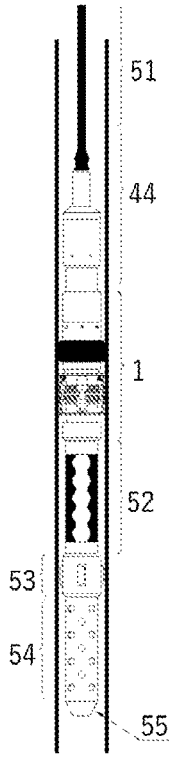
FIG. 14. shows the coupling between the retriever device and the packer for later extraction.
Figure 15:
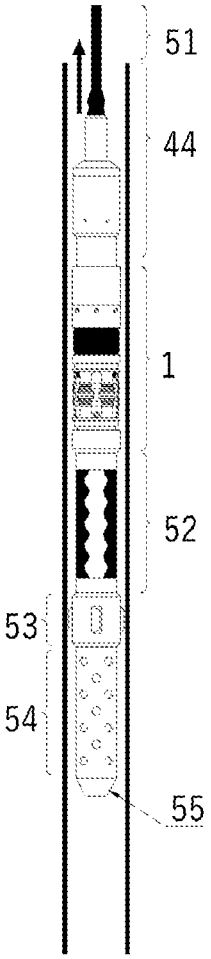
FIG. 15. is about the extraction as a set of the packer, retriever device and the BHA elements.

The release connection element 4 has a release mechanism which, when located with the retriever device 44, enables said internal release mechanism to be activated and the packer unit 1 to be recovered, see FIG. 6B. The connection release element 4 can be made of any of the following materials; SAE/AISI 1030, 1035, 1040, 1045, 1050, 1060, 1095, 4130, 4140, 4340, preferably AISI-4140. The release connection element 4 has an internal upper surface region that can be used for complementary stop with the packer holding holder 34.

The upper safety retainer 5 in conjunction with the safety ring 3 allows the anchoring and sealing of the packer unit 1 to settle, by means of displacement of the assembly set due to the internal travel of the settling device due to the hydraulic pressure exerted in the well, received directly on 30*a* and 30*b*. The upper safety retainer 5 can be made of any of the following materials; SAE/AISI 1030, 1035, 1040, 1045, 1050, 1060, 1095, 4130, 4140, 4340, preferably AISI-4140. The upper safety retainer 5 has a thread to be joined by threading with the lower safety retainer 7. Also said upper safety retainer 5 has a complementary thread to be joined by threading with the safety ring 3.

The seal holder 6 is a metallic element that allows the internal sealing between the mandrel 2 and the seal holder itself 6, as well as being a support for the sealing element 8. Between mandrel 2 and seal holder 6 there is a pair of O-Rings 19*a*, 19*b* The seal holder 6 can be made of any of the following materials; SAE/AISI 1030, 1035, 1040, 1045, 1050, 1060, 1095, 4130, 4140, 4340, preferably AISI-41140. The seal holder 6 has a hollow cylindrical body Oriented from down to up, it has a first radial surface region, next said seal holder 6 has a second radial surface, the first radial surface region has a diameter less than the second radial surface region. Oriented from down to up, internally said seal holder 6 has three sections each one with different diameters, that diameters increase for each section. In the intermediate section has a pair of internal grooves to place a pair of O-rings 19*a*, 19*b*. The seat holder 6 has at least one through hole, that installed match with other packer's elements and can be linked by at least one pin. Said at least one hole located at the external second radial surface region. At the lower end, said seal holder 6 has an external thread to join the upper compression element 9.

The lower safety retainer 7 in conjunction with the upper safety retainer 5, allows the displacement of the anchor element 10 and the sealing element 8. The lower safety retainer 7 can be made of any of the following materials SAE/AISI 1030, 1035, 1040, 1045, 1050, 1060, 1095, 4130, 4140, 4340, preferably AISI-4140. The lower safety retainer is 7 a hollow cylindrical body. Externally has a continuous diameter. Internally, oriented from down to up has a bump at the internal corner end, for use as stopper, also said lower safety retainer 7 has two radially equidistant through holes, that installed match with other packer's elements and can be linked by breakouts pins 18*a*, 18*b*, according to FIG. 1B, or 18*a*, 18*b*, 18*c*, 18*d* according to FIG. 1C, or as long as the number of second breakdown pins is between a minimum of 1 and a maximum of eight, in accordance with what is stated in reference [0073]. Such holes located close to the upper end. The lower safety retainer 7 has a thread that will be screwed together with the upper safety retainer 5.

The sealing element 8 maintains the sealed between the well pipeline, and the packer unit 1. The sealing element 8 it is made of nitrile material, preferably 80 nitrile material, alternatively another copolymer or polymer with similar properties may be selected.

The upper compression element 9 and lower compression element 11 activate the anchoring system for anchoring the packer unit. The anchoring system comprises: the anchor element 10, upper compression element 9 and the lower compression element 11. Said upper compression element 9 and lower compression element 1 can be manufactured from any of the following materials; SAE/AISI 1030, 1035, 1040, 1045, 1050, 1060, 1095, 4130, 4140, 4340, preferably AISI. At the upper end said upper compression element 9 has an internal thread in order to joint to the seal holder 6. The upper compression element 9 has three holes to place first security pins 15*a*, 15*b*, 15*c*. The lower compression element 11 has three holes to place second security pins 16*a*, 16*b*, 16*c*.

As can be seen at FIG. 2C the connection between the anchor element 10, and the upper compression element 9 and the lower compression element 11 respectively is shown.

The anchor element 10 allows anchoring between the production pipeline and the packer unit 1 at the programmed depth. The anchor element 10 is made preferably from AISI 4140 material, alternatively being able to be manufactured from any of the following selected steels, SAE/AISI 1030, 1035, 1040, 1045, 1050, 1060, 1095, 4130, 4140, 4340. The anchor element 10 has six longitudinal slots radially spaced 60° between each one, to place alternatively, ON and OFF, each first security pins, 15*a*, 15*b*, 15*c* and each second security pins 16*a*, 16*b*, 16*c*. Each first security pin, whatever from 15*a*, 15*b*, 15*c* is located at the opposite end respect the location that could be occupied by a pin anyone chosen between 16*a*, 16*b*, 16*c*. ON means that one pin is fixed at correspondent location, OFF means that one pin is not fixed, is absent at said correspondent location, in other words if any slot at the one end is occupied by any pin whatever from 15*a*, 15*b*, 15*c* then in the same slot isn't fixed by any pin from 16*a*, 16*b*, 16*c* at the opposite end, and if any slot is occupied by any pin from 16*a*, 16*b*, 16*c* then at the same slot isn't occupied at the other end by any pin whatever from 15*a*, 15*b*, 15*c*. This configuration slots based, allows a more effective coupling and decoupling between elements, in addition to a better distribution of the forces to which the system is subjected.

An anti-friction ring 12 is available, which is a metallic element that prevents friction between the anti-friction retainer 13 and the lower connector 14. This anti-friction ring 12 can be manufactured from any of the following materials; SAE/AISI 1030, 1035, 1040, 1045, 1050, 1060, 1095, 4130, 4140, 4340, preferably AISI-4140

Likewise, the anti-friction retainer 13 holds fixed the anti-friction ring 12 and the lower connector 14. The anti-friction retainer 13 can be manufactured from any of the following materials SAE/AISI 1030, 1035, 1040, 1045, 1050, 1060, 1095, 4130, 4140, 4340, preferably AISI-4140. The anti-friction retainer 13 has a hollow cylindric body. Oriented from down to up, said anti-friction retainer comprise externally two surface radial regions, a first lower surface radial region and a second tipper radial region, where said first lower radial region has a diameter higher than the second upper radial region, thus locus where change from said first lower radial region to second upper radial region is a lower border corner where is located the anti-friction ring 12, thus it being secured Next to said corner on the second upper region is located a pair of grooves to insert O-rings 20*a*·, 20*b* and next up to said grooves there are radial blind holes plurality to insert pins Oriented down to up, internally the anti-friction retainer 13 has a second radial surface region internal at the upper end with higher internal diameter than the next first radial surface region internal, and at upper internal end has a groove to place a single O-ring 21. Next to the internal groove the second radial surface region is threaded until the limits with the other region, the first radial surface region internal, the border between both regions is used as stopper Said second radial surface region is threaded to joint to first mandrel 2.

The lower connector 14, connects the packer unit 1 to the stator of a conventional PCP and allows to avoid the backspin effect produced when the PCP motor stops. The Lower Connector 14 can be manufactured from any of the following materials SAE/AISI 1030, 1035, 1040, 1045, 1050, 1060, 1095, 4130, 4140, 4340, preferably AISI-4140

A first security pins set; 15*a*, 15*b*, 15*c*, and a second security pins set, 16*a*, 16*b*, 16*c*, is available, which is a safety guide for the anchor element 10, as seen at FIG. 2C, where each are disposed of each side of the anchor element 10. Those first security pins set; 15*a*, 15*b*, 15*c*, and second security pins set; 16*a*, 16*b*, 16*c*, can be manufactured from any of the following materials SAE/AISI 1030, 1035, 1040, 1045, 1050, 1060, 1095, 4130, 4140, 4340, preferably AISI-4140

As can be seen in FIG. 1B, both the security pins set, first security pins set: 15*a*, 15*b*, 15*c* as the second security pins set; 16*a*, 16*b*, 16*r* are radially equidistant disposed between each other, so approximately 120° between each one.

Said first security pins 15*a*, 15*b*, 15*c* and said second security pins; 16*a*, 16*b*, 16*c*, are not designed to break at any stage of the process, they only function is as a guide for the upper compression element 9 and the lower compression element 11, and also to support and guide the anchor element 10.

As can be seen in FIG. 2C, the first security pins; 15*a*, 15*b*, 15*c* connect the anchor element 10 to the upper compression element 9. The second security pins 16*a*, 16*b*, 16*c* connect the anchor element 10 to the lower compression element 11.

A first breakout pins set; 17*a*, 17*b*, 17*c*, 17*d*, and a second breakout pins set: 18*a*, 18*b*. According to the general embodiment of the invention based on FIG. 1B, or according to the preferred embodiment based on FIGS. 1C, 18*a*, 18*b*, 18*c*, and 18*d*, or in any case, the number of second break pins is between at least one and eight at most, in accordance with what is stated in reference. Both the first set of breakout pins 17*a*, 17*b*, 17*c*, 17*d*, as well as the second set of breakout pins are 18*a*, 18*b*, or if four are chosen in quantity; 18*a*, 18*b*, 18*c*, and 18*d*, form two sets. Said second breakout pins 18*a*, 18*b*, or if four are chosen in quantity; 18*a*, 18*b*, 18*c*, and 18*d* hold the first mandrel 2 fixed to the connection release point 4 and to the lower safety retainer 7 as seen in FIG. 2B. Both the first set of breakdown pins and said second set of breakdown pins can be manufactured in any of the following material ranges: B505-C854, B505-C844 and B505-C932, preferably SAE-660.

As can be seen in FIG. 1B, the first breakout pins are arranged radially equidistant from each other, approximately 90° between each other and the second breakout pins: 18*a*, 18*b*, are arranged radially equidistant from each other, thus approximately 180° from each other. If four second breakout pins are used, 18*a*, 18*b*, 18*c*, and 18*d*, the respective offset corresponds to approximately 90° between each. In any cases unless a single second breaking pin is used, as long as you choose between two and eight in quantity (See ref [0073]) the location will always be equidistant between each one.

As can be seen in FIG. 23, the first breakout pins 17*a*, 17*b*, 17*c*, 17*d* connect the release connection element 4 to the first mandrel 2. The second breakout pins 18*a*, 18*b*, or if you choose employ four in number; 18*a*, 18*b*, 18*c*, and 18*d*, or as long as the number of second breakout pins is between a minimum of one and a maximum of eight, in accordance with what is stated in reference [0073], connect the lower safety retainer 7 to the first mandrel 2.

The O-rings 19*a*, 19*b*, 20*a*. 20*b* and 21 are seals to prevent packer unit 1 internal leakage. Said O-rings are made preferably from nitrite material, alternatively, another copolymer or polymer with similar properties can be selected. O-rings 20*a*, 20*b* and 21 are installed in the anti-friction retainer 13. O-ring 21 is inserted in the internal slot of the anti-friction retainer 13, and likewise O-rings 20*a*, 20*b* is insert on the external grooves of the anti-friction retainer 13.

The Allen stud 22, or if it is chosen to employ four in the number of Allen 22*a*, 22*b*, 22*c*, and 22*d* studs, or as long as their number is in the range of at least one and a maximum of six, in accordance with reference 100701, which is a function depending on the operating case, they are preferably ½"NC, and manufactured from grade 8 steel. The aforementioned Allen studs do not have the function of breaking during the operation of the system, their function is to allow the fixing between the element lower compression element 11 and anti-friction element 13.

FIG. 1B allows observing the spatial arrangement of the first security pins, the second security pins, the first breakout pins, the second security pins, and the Allen stud. The first security pins are arranged 90° between them in the upper part of the first second mandrel, this is between the surface with the largest diameter and the toothed region of the same.

The packer unit 1 is by recoverable hydraulic settlement that active packer's elements for mechanic displacement of those, and said packer unit 1 is formed by the first mandrel 2, which supports other elements of the packer unit, this first mandrel 2 consists of an elongated cylindrical body that in turn has three regions on its upper surfaces with a change in diameter from smaller to larger, and in each of said regions it has a respective hole with respective assembly functions to the rest of the components, in the distal portion of the region of greater diameter it also has a radial toothed section to facilitate the coupling with the release connection element 4, the tipper safety retainer 5, and the seal holder 6, with which facilitates telescopic movement of the unit, this is circumferentially around the external surface of said first mandrel 2, said elements are; the seal holder 6, the lower safety retainer 7, the sealing element 8, the upper compression element 9, the anchor element 10, and the lower compression element 11. The packer unit 1 has a set of second break pins 18*a*, 18*b*, or, if you choose to use a number four: 18*a*, 18*b*, 18*c*, 18*d*, or as long as the number of second breakout pins is between a minimum of one and a maximum of eight, in accordance with what is stated in reference [0073], it depends on the operating case of which the lower set it works for seating by the seating device 23, allowing the displacement movement of the upper compression elements, where said compression elements comprise; the seal support 6, the lower safety retainer 7, the sealing element 8 and the upper compression element 9, which actuate and/or expand the anchor element 10 and the sealing element 8. The other set of pins 17*a*, 17*b*, 17*c*, 17*d* is tension sheared and allows the system of elements to relax; the seal support 6, the lower safety retainer 7, the sealing element. 8, the upper compression element 9, the anchor element 10, resulting in the recovery of the packer unit 1 through the retriever device 41, see Figure S.

The packer unit 1 can be assembled for storage, or to be used operatively, on the last choice that must be done with the settling device 23. The details will be explained later.

B. Settling Device.

The settling device includes all components, can be observed at FIGS. 3, 4A, 4B, and 4C.

Figure 3:
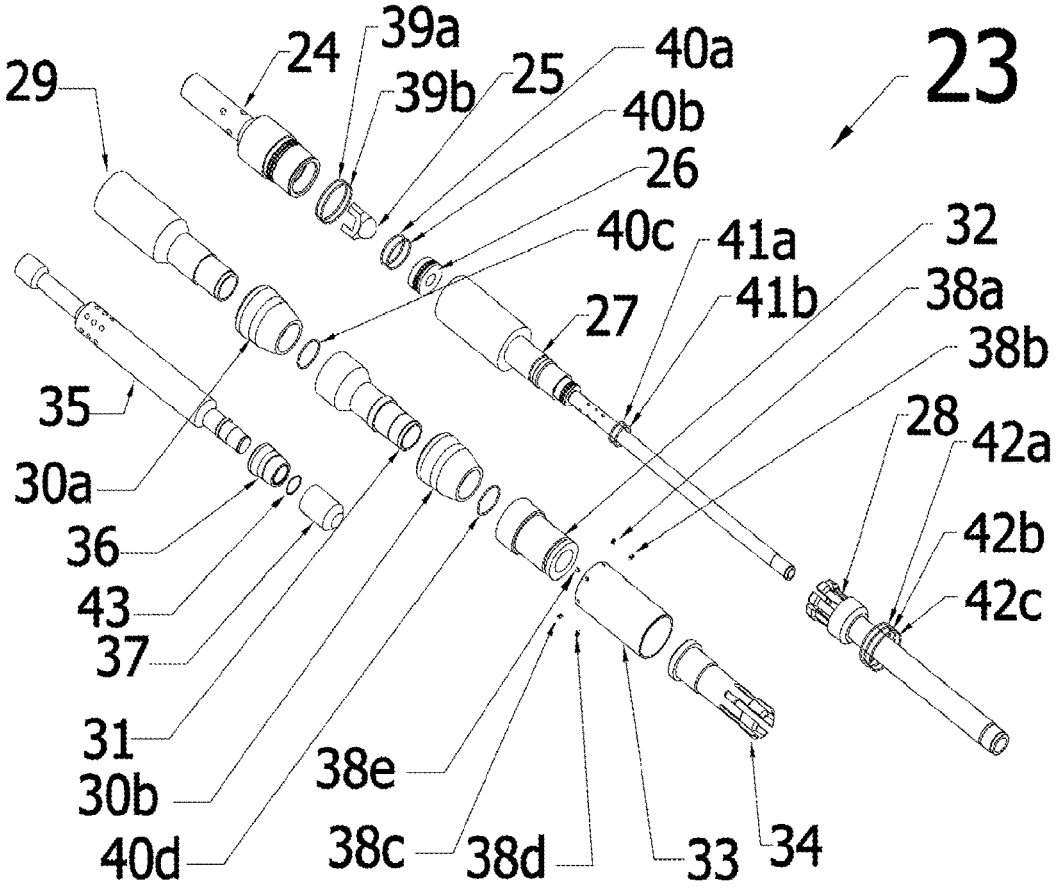
FIG. 3 is related to the settle device assembly.

Said packer unit 1 described above requires for its installation, a settling device 23, see FIG. 3. Its main function is to convert the hydraulic pressure into mechanical displacement towards the mobile components of the packer unit 1, achieving the fixation and seal to the pipe of production in which it is installed. The mobile packer's components are; upper safety retainer 5, safety ring 3, lower safety retainer 7, sealing element 8, upper compression element 9, and the lower compression element 11.

This settling device 23 comprising; an upper connector 24, a piston 25, a piston seat 26, a seat holder 27, a second mandrel 28, a cup holder sleeve 29, a pair of cups; upper cup 30A, lower cup 30*b*, an upper cup holder connector 31, a lower cup holder connector 32, a release pin holder 33, a packer holding connector 34, a clamp connector retainer 35, a packer's seal test cup 36, test cup retainer 37, a set of six release pins 38*a*, 38*b*, 38*c*, 38*d*, 38*e*, 38*f*, a set of O-rings 39*a*, 39*b*, 40*a*, 40*b*, 40*c*, 40*d*, 41*a*, 41*b*, 42*a*, 42*b*, 42*c*, and 43.

Each cited settling device element has a specific function within the settling device assembly 1, where for each case is specified below in support of FIGS. 3, 4A, 4B, and FIGS. 7 to 11.

The upper connector 24 allows connection to the rods string 51, Said upper connector 24 is made preferably made of AISI-4140 material, and can alternatively be manufactured from any of the following selected steels, SAE/AISI 1030, 1035, 1040, 1045, 1050, 1060, 1095, 4130, 4340. The piston seat has a pair of radial grooves on its surface to place the O-rings 39*a*, and 39*b*, the grooves is located at the intermediate portion of said upper connector 24. At the upper connector 24 lower portion is located an external threated region for joint with the seat holder 27.

The piston 25 is a metal-to-metal sealing element. This piston 25 is preferably made of AISI-4140 material, and can alternatively be manufactured from any of the following selected steels. SAE/AISI 1030, 1035, 1040, 1045, 1050, 1060, 1095, 4130, 4340.

The piston seat 26 is the component where the piston 25 coupling, to close circulation and allow pressure increase. This piston seat 26 is preferably made of AISI-4140 material, and can alternatively be manufactured from any of the following selected steels; SAE/AISI 1030, 1035, 1040, 1045, 1050, 1060, 1095, 4130, 4340. The piston seat 26 has a pair of radial grooves on its surface to place the O-rings 40*a*, and 40*b*.

The seat holder 27 serves as a receptacle for the piston seat 26 and the piston 25, together it performs the function of a one-way salve. This seat holder 27 is preferably made of AISI-4140 material, and can alternatively be manufactured from any of the following selected steels; SAE/AISI 1030, 1035, 1040, 1045, 1050, 1060, 1095, 4130, 4340. The upper portion of seat holder has a threated internal region to connect to upper connector 24. The seat holder 27 has a head and an elongated body, the head arranged in a higher part and the elongated body of continuous cross section to the lower end, the head with five radial sections each with ascending diameter in the upward direction, and in where in the first radial section from bottom to top it has a pair of radial grooves to install the pair of O-rings 41*a*, 41*b*. At the third radial section oriented from down to up there is provided a radial groove for seating the radial toothed portion of the second mandrel 28 the free lower end of the elongated body has a threaded outer surface.

The second mandrel 28 allows the connection of the piston seat holder 27 to the packer holding connector 34, as well as serving as a support for the cup holder sleeve 29, the pair of cups 30*a*, 30*b*, the O-ring's 40*a*, 40*b*, 40*c*, 40*d*, the upper cup holder connector 31, the lower cup holder connector 32, and the release pin holder 33. Said second mandrel 28 is preferably made of AISI-4140 material, and can alternatively be manufactured from any of the following selected steels: SAE/AISI 1030, 1035, 1040, 1045, 1050, 1060, 1095, 4130, 4340. The second mandrel 28 has a head upper located, and an elongated body lower located, oriented from down to up, the head comprises a first radial surface portion, that has available three grooves to place O-ring's 42*a*, 42*b*, 42*c*, and a following radial surface portion toothed, whose teeth must fit in the groove available in seat holder 27. The length of the second mandrel 28 elongated body is a little less than the length of the seat holder 27 elongate body. The second mandrel 28 lower end is external threaded to connect to the packer holding connector 34.

The cup holder sleeve 29 keeps the upper cup 30*a* connected to the upper cup holder connector 31, also keeps the lower cup 30*b* connected to the lower cup holder connector 32. This cup holder sleeve 29 is preferably made of AISI-4140 material and can alternatively be manufactured from any of the following selected steels; SAE/AISI 1030, 1035, 1040, 1045, 1050, 1060, 109, 4130, 4340. Oriented from down to Up, the cup holder sleeve 29 has a first radial surface region, that is continuous less an intermediate part that has a greater diameter for use as stop. Following said first radial surface region is available a second radial surface region that limits its displacement by stop with the change in diameter section between fourth and fifth seat holder 27 radial sections. The begin of the first radial surface region is external threated for connect to upper cup holder connector 31.

The cups, upper cup 30A and lower cup 30*b* are double-acting sealing elements between the well pipeline and the settling device 23. They allow the unidirectional flow of fluids. These upper cup 30*a*, and lower cup 30*b*, are made preferably from nitrile material, alternatively, another copolymer or polymer with similar properties can be selected. The upper cup at the external lower end has a groove to put the O-ring 40*c*. The lower cup at the external lower end has a groove to put the single O-ring 40*d*.

The upper cup holder connector 31 has an internal profile for coupling to the upper cup 30*a*, it supports said upper cup 30*a*. This upper cup holder connector 31 is preferably made of AISI-4140 material, and can alternatively be manufactured from any of the following selected steels; SAE/AISI 1030, 1035, 1040, 1045, 1050, 1060, 1095, 4130, 4340. Oriented from down to up, the upper cup holder connector has a first radial surface region, that is that is continuous less an intermediate part that has a greater diameter for use as stop. Following said first radial surface region is available a second radial surface region that limits its displacement by stop with the O-ring 40*c*, and also has an internal threaded region to connect to the cup holder sleeve 29, and at first surface region has an external threaded region to connect to the lower cup holder connector 32.

The lower cup holder connector 32 has an internal profile for coupling to the lower cup 30*b*, it supports said lower cup 30*b*. Said lower cup holder connector 32 is preferably made of AISI-4140 material, and can alternatively be manufactured from any of the following selected steels; SAE/AISI 1030, 1035, 1040, 1045, 1050, 1060, 1095, 4130, 4340. Oriented from down to up, the lower cup holder 32 has a lower section with a radial groove to allowed the release pins 38*a*, 38*b*, 38*c*, 38*d*, 38*e*, 38*f*, and an upper section with an internal threaded region to connect to the upper cup holder connector 31.

As can be seen at FIG. 41B, the cup system comprising the upper cup 30*a* connect to upper holder connector 31 and the cup holder sleeve 31 and fixed all by O-ring 40*c*, and the lower cup 30*b* is connected to lower cup holder by a single O-ring 40*d*.

The release pin holder 33 holds the release pins 38*a*, 38*b*, 38*c*, 38*d*, 38*e*, 38*f*. This pin holder 33 is preferably made of AISI-4140 material, and can alternatively be manufactured from any of the following selected steels; SAE/AISI 1030, 1035, 1040, 1045, 1050, 1060, 1095, 4130, 4340. The release pin holder 33 has six radially equidistant through holes, that installed match with other packer's elements and can be linked by release pins 38*a*, 38*b*, 38*c*, 38*d*, 38*e*, 38*f*. A alternative embodiment includes that the release pin holder has a plurality holes, different to six, for holds the same number of release pins.

The packer holding connector 34 is the connection point between the settling device 23 and the packer unit 1. Said packer holding connector 34 is preferably made of AISI-4140 material, and can alternatively be manufactured from any of the following selected steels: SAE/AISI 1030, 1035, 1040, 1045, 1050, 1060, 1095, 4130, 4340. The packer holding connector 34 has an internal threaded at upper region to connect to the second mandrel 28. The packer holding holder 34 has an intermediate surface region with a diameter less than the packer holding connector's upper and lower region, for that lower end can be used as stop with the release connection point 4.

The clamp connector retainer 35 holds packer holding connector 34 secure during packer unit 1 run. This clamp connector retainer 35 is preferably made of AISI-4140 material, and can alternatively be manufactured from any of the following selected steels; SAE/AISI 1030, 1035, 1040, 1045, 1050, (060, 1095, 4130, 4340. The clamp connector retainer 35 has a plurality of through holes for evacuate fluid from settling device 23 to well, when settling device 23 is extracted. Also has a lowest end externally threated to joint to the test cup retainer 37.

The packer's seal test cup 36 creates a necessary seal to prevent fluid flow into the well and test the packer unit 1 seal. Said packer s seal test cup 36 is made preferably from nitrile material, alternatively, another copolymer or polymer with similar properties can be selected. Said packer's seal test cup 36 is a hollow cylindric, and at the internal lower end has a pair of grooves, at the lowest groove is placed a single O-ring 43. The inner diameter is enough for adjust to lower external diameter end of the clamp connector retainer 35.

Alternatively, said packer's seal test cup 36 can be replaced by devices of similar function in order to generate an internal seal, within the range of options and/or application type "S" seals, type seals can be used. "T", "V" type seals, made of different materials such as nitrile, viton, as well as other similar polymers or copolymers.

The test cup retainer 37 has an internal profile for coupling to the packer's seal test cup 36 and holds said packer's seal test cup 36. This cup retainer 37 is preferably made of AISI-4140 material, and can alternatively be manufactured from any of the following selected steels; SAE/AISI 1030, 1035, 1040, 1045, 1050, 1060, 1095, 4130, 4340. Said test cup retainer 37 is like a blind nut, with an internal thread to joint to lowest external thread of the clamp connector retainer 35.

Figure 4A:
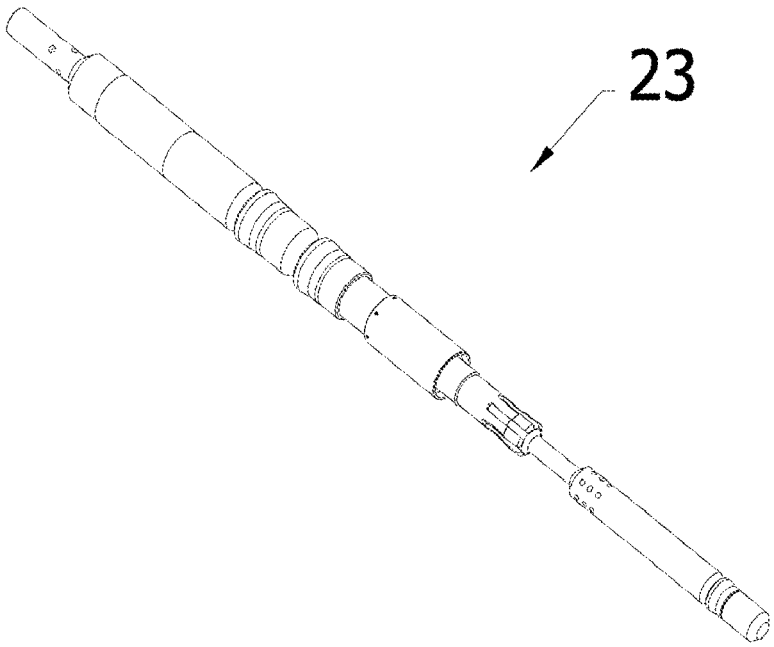
FIG. 4A shows the settle device as a whole.
Figure 4B:
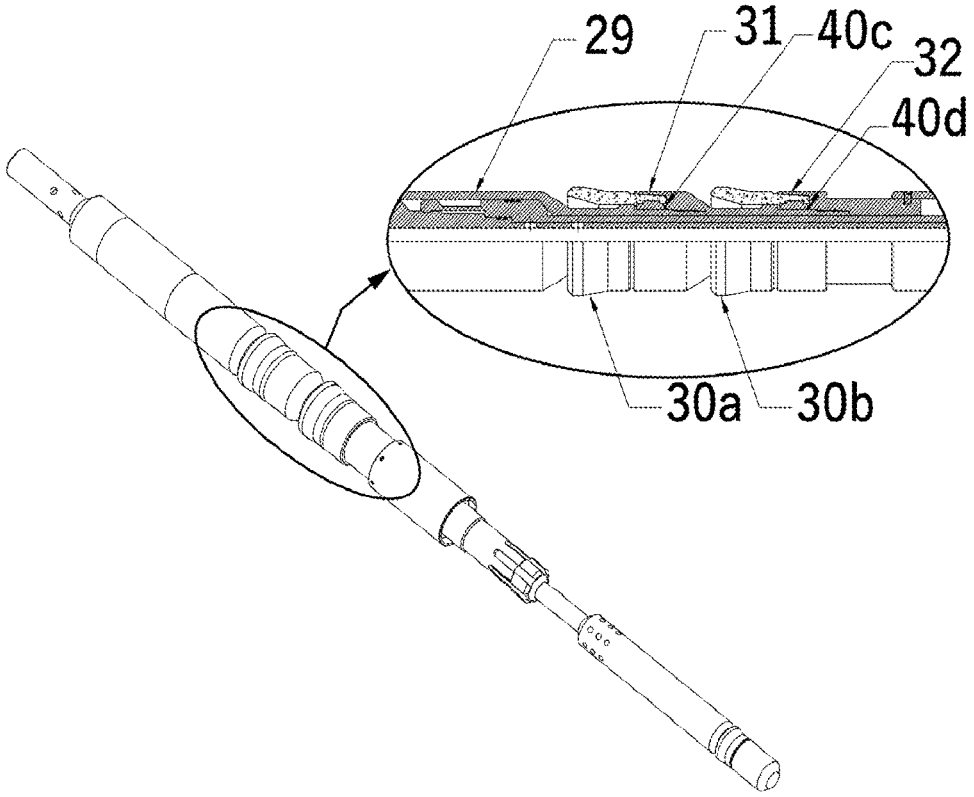
FIG. 4B. is about a longitudinal partial cross section detail of settling device that shows cups system.
Figure 4C:
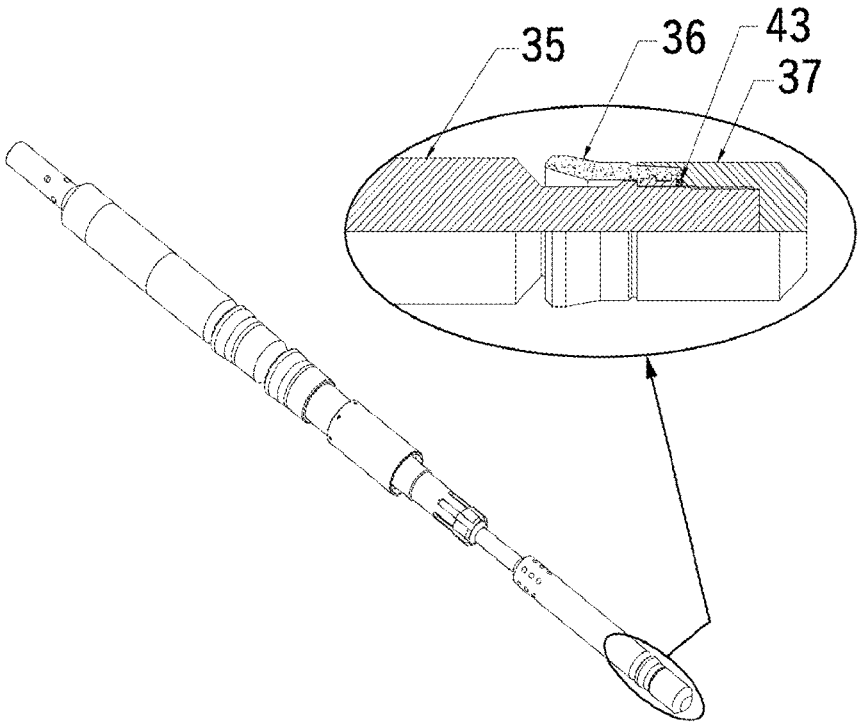
FIG. 4C, is about a longitudinal partial cross section detail of settling device that shows the assembly of the clamp connector retainer, the packer's seal test cup, and the test cup retainer.

In FIG. 4C shows connections between the clamp connector retainer 35, the packer's seal test cup 36, and test cup retainer 37, fasten by a single O-ring 43.

The release pins 38*a*, 38*b*, 38*c*, 38*d*, 38*e*, 38*f* keep the settling device 23 fixed to the packer unit 1, until they are sheared due to the applied pressure. These release pins 38*a*, 38*b*, 38*c*, 38*d*, 38*e*, 38*f* are preferably made of SAE-660 material, although alternatively they can be manufactured in any of the following material ranges B505-C854, B505-C844 and R505-C932. Said release pins 38*a*, 38*b*, 38*c*, 38*d*, 38*e*, 38*f*, are the seconds to break, due to hydraulic pressure, after Packer unit 1 is settled, to release the settling tool 23, these release pins 38*a*, 38*b*, 38*c*, 38*d*, 38*e*, 38*f* fix the release pin holder 33 with the lower cup holder connector 32.

The set of O-rings 39*a*, 39*b*, 40*a*, 40*b*, 40*c*, 40*d*, 41*a*, 41*b*, 42*a*, 42*b*, 42*c*, and 43, they are universally arranged to prevent internal leakage from the settling device 23. These set of O-rings 39*a*, 39*b*, 40*a*, 40*b*, 40*c*, 40*d*, 41*a*, 41*b*, 42*a*, 42*b*, 42*c*, and 43 are made preferably from nitrile material, alternatively, another copolymer or polymer with similar properties can be selected.

To operate in the well, the installation of packer unit 1 requires that it be initially assembled with the settling device 23. The assembly is carried out in orientation from the up to the down, remembering that the up portion is the one distant relative to the well, and the down portion is the closest, said process which implies an assembly process defined by the following steps;

Provide a bench vise.

Fasten the upper portion of the upper connector 24 with the bench vise and press it.

Insert the piston 25 concentrically into the upper connector 24, until said piston 25 stops and is completely covered by said upper connector 24, leaving a free internal surface of the said upper connector 24.

Install the O-rings 40*a*, 40*b* at the piston seat 26

Insert the portion of the piston seat 26 that contains the O-rings 40*a*, 40*b* previously placed there, concentrically into the upper connector 24 free inner surface.

Install the O-rings 39*a*. 39*b* at upper connector 24

Thread the seat holder 27 to the upper connector 24

Install O-rings 41*a*, 41*b* at the grooves available at the seat holder 27

Slide the second mandrel 28 concentrically onto the seat holder 27.

Install the O-rings 42*a*, 42*b*, 42*c*, at the second mandrel 28.

Insert the cup holder sleeve 29 into the second mandrel 28.

Slide the upper cup 30*a* concentrically in the cup holder sleeve 29, until stop.

Put a single O-ring 40*c* onto upper cup 30*a*.

Thread upper cup holder connector 31 to the cup holder sleeve 29, until stops with O-ring 40*c*.

Slide the lower cup 30*b* concentrically on the upper cup holder connector 31, until stop.

Put a single O-ring 40*d* onto upper cup 30*b*.

Thread the lower cup holder connector 32 to the upper cup holder connector 31.

Introduce concentrically the release pin holder 33 until stops with the lower cup holder connector 32.

Thread the packer holding connector 34 to the second mandrel 28.

From this point on, elements from packer unit 1 begin to be incorporated.

Insert the upper safety retainer 5 concentrically into the packer holding connector 34, slide it as far as it will go with the release pin holder 33.

Insert the release connection point 4 through the packer holding connector 31, concentrically slide it as far as stop with the packer holding connector 34.

Place the safety ring 3 onto the first mandrel 2 groove.

Introduce and slide the first mandrel 2 concentrically onto the release connection point 4, until said release connection point 4 move and following stop in relation to the packer holding connector 34.

Connect the first mandrel 2 with the release connection point 4 by the first breakout pins 17*a*, 17*b*, 17*c*, 17*d*.

Thread the clamp connector retainer 35 to the seat holder 27.

Install a pair of O-rings 20*a*, 20*b* at the internal seal holder 6 grooves.

Introduce concentrically the seal holder 6, slide it as far as stop with the first mandrel 2.

Introduce concentrically the lower safety retainer 7 and slide it as far as stop with the seal holder 6.

Thread the lower safety retainer 7 to the upper safety retainer 5.

Align and fix the upper safety retainer 5 to the lower Safety retainer 7 with the second breakout pins; either 18*a*, 18*b* or 18*a*, 18*b*, 18*c*, 18*d*, or as long as the number of second break pans is between a minimum of 1 and a maximum of eight, in accordance with what is stated in reference [0073].

Align and fix the release pin holder 33 to the lower cup holder connector 32 with release pins 38*a*, 38*b*, 38*c*, 38*d*, 38*e*, 38*f*.

Introduce the sealing element 8 to the seal holder 6.

Thread upper compression element 9 to the seal holder 6.

Introduce the anchor element 10 and slide it as far as stop with the upper compression element 9.

Introduce the lower compression element 11 and slide it as far as stop with the anchor element 10.

Place the anti-friction ring 12 onto anti-friction retainer 13 lower border corner.

Place O-rings 20*a*, 20*b* onto anti-friction 13 retainer external grooves.

Introduce the lower connector 14 and slide first from down to up and then from up to down until it as far as stops with the anti-friction ring 12.

Place O-ring 21 onto anti-friction retainer 13 retainer internal groove.

Thread anti-friction retainer 13 to first mandrel 2.

Align the upper compression connector 9 with the sealing element 8 and place at both the first security pins 15*a*, 15*b*, 15*c*.

Align the lower connector 11 with the anchor element 10 and place at both second security pins 16*a*, 16*b*, 16C interspersed with the first security pints 15*a*, 15*b*, 15*c* installed previously on the upper compression connector 9.

Align the lower compression connector 11 with the anti-friction retainer 13 fixing both with the Allen stud 22, or if selection by four in number by means of the allen studs 22*a*, 22*b*, 22*c*, 22*d*, or as long as the quantity is within the range declared in reference [0070]

Insert the packer's seal test cup 36 into clamp connector retainer 35.

Internally install O-rings 43 into the packer's seal test cup 36.

Thread the test cup retainer 37 to the clamp connector retainer 35.

The settling device 23 is connected by threading to the rods string 51 from the top and couples to the Packer unit 1 from the bottom by means of an internal coupling system, this settling device 23 has a system of two inverted cups 30*a*,

30*b*, which prevent the flow of fluids to the well and that make a mechanical travel product of the hydraulic pressure exerted by the fluid column in the pipeline and the pressure of a triplex positive displacement pump on the surface.

Operatively, the settling device 23 initially operates with the packer unit 1. The pressure is exerted from the surface to the cups 30*a* and 30*b*, the cup 30*b* operate as a contingency in case of failure of the cup 30*a*, due to friction or some type of damage in the integrity of the cup 30*a*, generating the closure of the piston 25 in the piston seat 26, the fluid flow to the well are closed and generating a mechanical displacement after breaking the second breakout pins ta, 18*b*, or as long as the number of second breakdown pins is between a minimum of one and a maximum of eight, in accordance with what is stated in reference [00731], generating the downward movement of the set defined by, the upper safety retainer 5, lower safety retainer 7, seal holder 6, sealing element 8, upper compression element 9, anchor element 10, continuing the movement until breaking the release pins 38*a*, 38*b*, 38*c*, 38*d*, 38*e*, 38*f*, leaving the second mandrel of the setting device 28 free.

This settling device 23 is extracted from the well by means of the extraction of the rods string 51 otter completing the installation process, to lower the rods string 51 and start producing the well.

The second breakout pins, 18*a*, 18*b*, or as long as the number of second breakdown pins is between a minimum of one and a maximum of eight, in accordance with what is stated in reference [0073], are the first to break due to the action of hydraulic pressure, to achieve the settlement of packer unit 1, they hold lower safety retainer 7 with the first mandrel 2.

C. Retriever Device.

Figure 5:
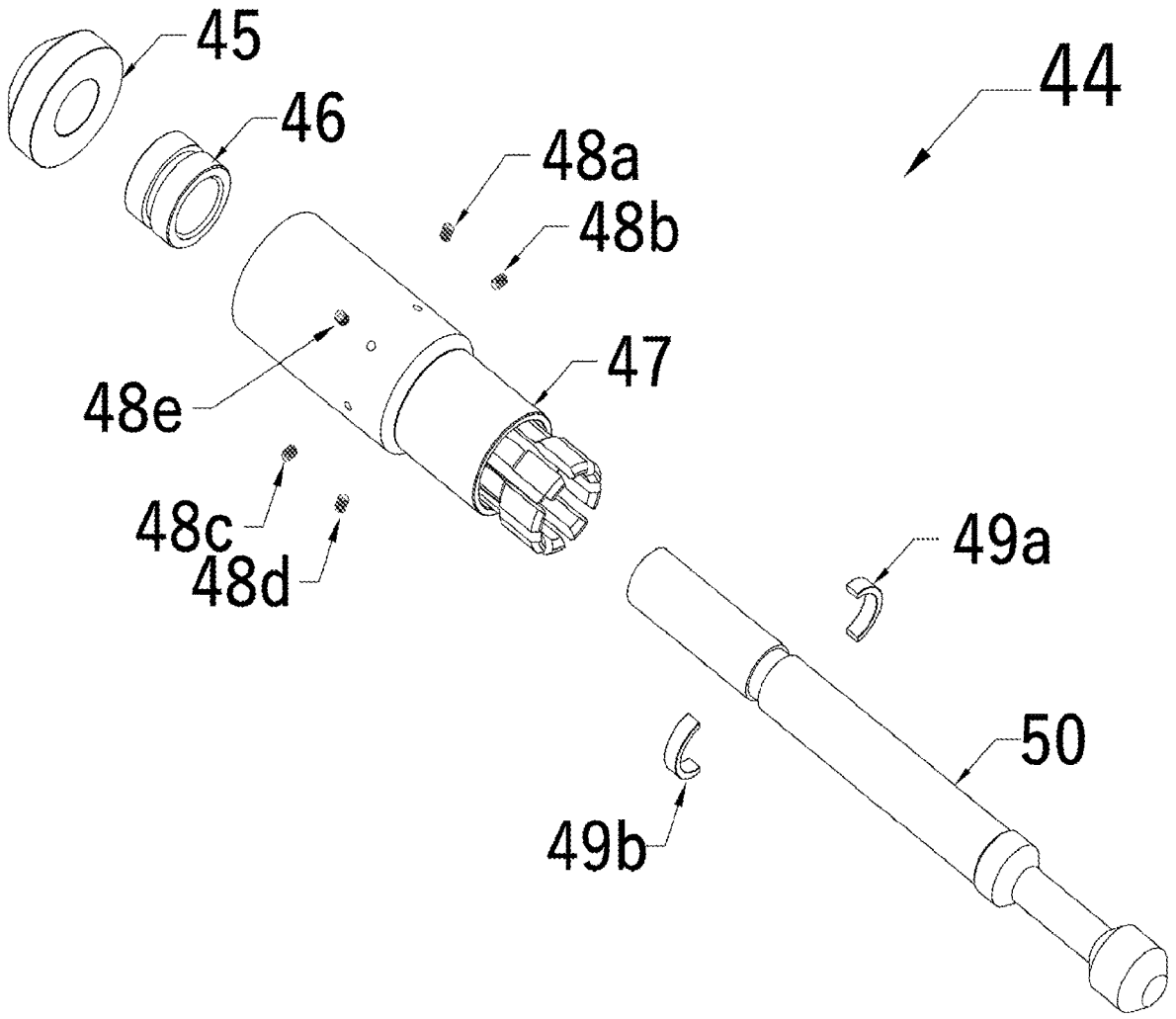
FIG. 5 is about to the retriever device assembly.

The retriever device includes all components, can be observed at FIGS. 5, 6A, and 6B.

Once the useful life of the production pump (PCP or MP) has expired, in is necessary to recover the packer unit 1 with the pump installed below it, for which the use of the retriever device 44 is necessary.

This retriever device 44 comprising an upper stop 45, a holder for security pins set 46, fishing connector 47, a security pins set 48*a*, 48*b*, 48*c*, 48*d*, 48*e*, 48*f*, a security ring 49*a*, 49*b*, an inner mandrel 50.

Each cited retriever device 44 element has a specific function within the retriever device assembly, where for each case it is specified below:

The upper stop 45 connects to the rods string 51 by threading, and allows to transmit weight on the fishing connector 47, and also tension to extract and % or recover the packer unit 1 with the pumping system. This upper stop 45 is made preferably from AISI-4140 material, being able to alternatively be manufactured from any of the following selected steels; SAE/AISI 1030, 1035, 1040, 1045, 1050, 1060, 1095, 4130, 4340.

The holder for security pins set 46 allows to fix the security pins set 48*a*, 48*b*, 48*c*, 48*d*, 48*e*, 48*f* to the fishing connector 47. Said holder for security pins set 46 is made preferably from AISI-4140 material, being able to alternatively be manufactured from any of the following selected steels. SAE/AISI 1030, 1035, 1040, 1045, 1050, 1060, 1095, 4130, 4340.

Said bolder security pin set 46 is a hollow cylindric with an external radial groove located approximately at the middle of its length, said groove match to the fishing connector radial through holes. The holder for security pins external diameter is enough to adjust to the inner diameter of the thud radial surface region of fishing connector 47.

The fishing connector 47 allows the retriever device 44 and packer unit 1 to be connected to the internal profile of release connection element 4. This fishing connector 47 is made preferably from AISI-4140 material, being able to alternatively be manufactured from any of the following selected steels, SAE/AISI 1030, 1035, 1040, 1045, 1050, 1060, 1095, 4130, 4340. The fishing connector 47 is a hollow cylindric with three radial surface regions, each one with different diameters, oriented from down to up, the fishing connector 47 comprise a first radial toothed region, a second radial surface region, and a third radial surface region. The first radial toothed region has approximately the same diameter than the second radial surface region, but both less than the third radial surface region. Each tooth from said first radial toothed surface region is lowest oriented. At the third radial surface region has six through holes equidistant radially spaced to insert said security pins set 48*a*, 48*b*, 48*c*, 48*d*, 48*e*, 48*f*. Those six through holes are located near to border corner limit between said third radial surface region and said second radial surface region The security pins set 48*a*, 48*b*, 48*c*, 48*d*, 48*e*, 48*f* are threaded that allows the union between the fishing connector 47 and the holder for security pins set 46. Said security pins set 48*a*, 48*b*, 48*c*, 48*d*, 48*e*, 4*f* are made preferably from SAE-660 material, although alternatively they can be manufactured in any of the following material ranges B505-C854, B505-C844 and B505-C932. Said security pins set 48*a*, 48*b*, 48*c*, 48*d*, 48*e*, 48*f*, are designed to break off in tension, in the event of release system failure, binding, or problems recovering the packer unit 1.

The security ring consists of two clamping shells 49*a*, 49*b* complementary, whose function is to prevent the displacement of the upper stop 45. This security ring 49*a*, 49*b* is made preferably from AISI-4140 material, being able to alternatively be manufactured from any of the following selected steels: SAE/AISI 1030, 1035, 1040, 1045, 1050, 1060, 1095, 4130, 4340.

The inner mandrel 50 facilitates connection to the rods string 51 and supports the fishing connector. Said inner mandrel 50 is made preferably from AISI-4140 material, being able to alternatively be manufactured from any of the following selected steels: SAE/AISI 1030, 1035, 1040, 1045, 1050, 1060, 1095, 4130, 4340.

The inner mandrel 50 has four radial regions Oriented down to up, has a first radial region that is a head, next a second radial region that is a neck, next there is three radial region that is the shoulder, and follow the four radial region is an elongated body. The head is adjusted internally with first radial toothed surface region of the fishing connector 47. The neck has a diameter less than the head. The shoulder is a stopper between said inner mandrel 50 and said holder for security pins set 46, and has approximately the same diameter than the head. On the elongated body has a groove to place the clamping shells 49*a*, 49*b*.

Said retriever device 44 consists of a six metallic elements set; upper stop 45, holder for security pins set 46, fishing connector 47, security pins set 48*a*, 48*b*, 48*c*, 48*d*, 48*e*, 48*f*, security ring consists of two clamping shells 49*a*, 49*b*, and inner mandrel 50, threaded in the upper part to the rods string 51 and in its lower part they connect and/or couple to the packer unit 1, once the correct coupling is made, tension force is applied, having effect on first breakout pins 17*a*, 17*b*, 17*c*, 17*d*, which are sheared by the displacement of the release connection point 4 upward by the effect of the tension exercised by the rods string 51, to shear and allow a path contrary to the one that occurred in the settlement process, which allows the profiles of the metal parts that kept, the anchorage system 9, 10, 11 and the sealing element 8, adhered to the internal walls of the production pipe, to relax or retract allowing the retrieve of the packer unit 1 and the crude extraction pump that is in the bottom, by means of the extraction of the rods string 51.

The first breakout pins 17*a*, 17*b*, 17*c*, 17*d*, are broken by the action of tension generated after connecting the retriever device 44, at the moment of recovering packer unit 1, when it is required to remove from the well.

When first breakout pins 17*a*, 17*b*, 17*c*, 17*d* are broken then retract allowing the release of the packer unit 1

The release mechanism according to the invention consists of the connection of the fishing connector 47 with the release connection point 4, then the movement upwards by the action of the tension of the rods string, allows the inner mandrel 50 to be coupled inside of the fishing connector 47. The inner mandrel 50 is telescoped and internally displaced with respect to the fishing connector 47 increasing the strength of the connection and allowing shear of the first breakout pins 17*a*, 17*b*, 17*c*, 17*d*, which allow that the lower and upper compression elements 11 and 9 respectively, as well as the anchor element 10, retract allowing the release of the packer unit 1.

The security pins set 48*a*, 48*b*, 48*c*, 48*d*, 48*e*, 48*f* are safety pins, when for any reason the packer unit 1 cannot come out and it is necessary to remove the rods string 51, tension is exerted until said security pins set 48*a*, 48*b*, 48*e*, 48*d*, 48*e*, 48*f*, break, releasing: rods string 51, inner mandrel 50, upper stop 45 and holder for security pins set 46, remaining in well the fishing connector 47 plus the packer unit 1, in order to continue the operation with other methods and recovery mechanisms used during drilling operations.

To maintenance duties at well, the packer unit 1 requires when due necessary that retrieved with the retriever device 44. In order to assemble said retriever device 44 must be done some steps;

(a) Provide a bench vise.

(b) Place fishing connector 47 in the bench vise and press it.

(c) Place the holder for security pins set 46 into fishing connector 47 and slide until it as far as stops with the inner border corner of the fishing connector 47.

(d) Use security pins set 48*a*, 48*b*, 48*c*, 48*d*, 48*e*, 48*f* to joint fishing connector 47 to the holder for security pins set 46.

(e) Insert the inner mandrel 50 into the fishing connector 47, slide it until it stops in the holder for security pins set 46.

(f) insert the upper stop 45 onto inner mandrel 50 and slide it until it stops with the fishing connector 47.

(g) Proceed to place both parts of the clamping shells 49*a*, 49*b* onto the outer groove of the inner mandrel 50. Make sure them fit completely onto groove.

(h) Finally, move the inner mandrel 50 until the clamping shells 49*a*, 49*b* press and stop with upper stop 45.

D. Process to Settling the Packer

FIGS. 7 to 11 show sequentially the stages to packer unit setting carry out, there it can be identified: the packer unit 1, the settling device 23, the rods string 51, the pipeline PCP 52, anti-torque anchor 53, perforated pipe 54 and a blind plug 55, and the rotor of the PCP 56.

The process to achieve this settling is described with the corresponding steps as below.

(a). Supply a packer unit, rods string 51, a progressive cavity pump stator and rotor, a calibration tool, a settling device 23, a valve to prevent blowouts, a blind plug 55, a perforated pipe 54, and an anti-torque anchor 53.

(b). Retrieve/remove rods string 51 with a PCP rotor 56.

(c). Supply a calibration tool with a known external diameter, according to the internal diameter of the tubing, greater than the external diameter of packer unit 1 for calibration (d) Calibrate the production pipe where the packer unit 1 will be installed, to ensure the lowering of the same without problems, with this calibration it is sought to guarantee the minimum internal diameter for the lowering of the packer unit 1 to guarantee the descent of said packer unit 1.

(e). Descend rods string 51, with calibration assembly to target depth.

(f). Fill production tubing according to capacity, until surface return is observed, close BOP and test production pipe between 380 to 3800 psi. Preferably 500 Psi (g). Pull out rods string 51 with calibration tool to surface (h) Assemble and calibrate BHA's; blind plug 55, perforated pipe 54 and anti-torque anchor 53, BCP stator with packer unit 1

(i). Connect the settling device 23 and packer unit 1 set to the PCP stator (j) Continue the rods string 51 run until programmed depth.

(k). Record the rods string 51 with BHA weight at the programmed depth, this is neutral weight going up and down (l). Fill the production tubing with control fluid, until the return is observed on the surface See FIG. 8, where shows the downward directional lines of pressure 56 caused by the control fluid.

(j) Close BOP's rams to make settling, and relaunch to pressure increase, up to the pressure calculated in the pre-operational meeting Once the necessary pressure is applied in the system, the piston valve system is closed; Piston 24, piston seat 25, seat holder 26, and pressure is received directly into the inverted cup system; upper cup 30*a*, and lower cup 30*b* where a mechanical displacement occurs, as a result of the pressure exerted by the hydrostatic column and the pump on the surface, shearing the packer's breakout pins, 18*a*, 18*b*, of if choose to use four in quantity: 18*a*, 18*b*, 18*c*, 18*d*, or as long as the number of second breakdown pins is between a minimum of one and a maximum of eight, in accordance with what is stated in reference [0073], to start the settlement process, and generating an external displacement that contracts the sealing element and the anchoring element, and consequently, an expansion of said elements towards the internal walls of the production pipe, generating anchoring and seal.

(n). Open BOP's rams and apply approximately between 3000 to 6000 lbs of weight and tension to verify the seating of pucker unit 1.

(o). Close BOP's rams to proceed to release the settling device 23, reaching the pressure already calculated in the pre-operational meeting. The increase in pressure generates the internal rupture due to shearing of the release pins 38*a*, 38*b*, 38*c*, 38*d*, 38*e*, 38*f*, which leaves the mechanism free and generates a disengagement the second mandrel 28, releasing the packer holding connector 34.

(p). Release pressure from the system, open BOP's rams and remove rods string 51 with settling device 23 to surface.

(q). Assemble PCP rotor plus rods string 51 and calibrate PCP rotor and run in with rods string 51, and test PCP.

Alternatively in step (n) the applied would be 4000 pounds of weight and tension D. Process to Retrieve the Packer FIGS. 12 to 15 show sequentially the stages to carry out the recovery of the packer unit 1, there it can be identified; the packer unit 1, the retriever device 44, the rods string 51, the tubular PCP 52, the anti-torque anchor 53, the perforated pipe 54, the blind plug 55, and the PCP rotor 56. These elements must be available to start the recovery procedure. Downhole assembly production design varies by well and user.

The retrieve process is described with the corresponding steps as below:

(a) Supply a packer unit 1, a retriever device 44, a rods string 51, a tubular progressive cavity pump (PCP) 52, an anti-torque anchor 53, a perforated pipe 54, a blind plug 55, and a pump rotor of progressive cavity (PCP) 56.

(b). Extract rods string 51 with PCP rotor 56.

(c) Assemble retriever device 44 plus rods string 51 and run down in BHA, until locating packer unit 1.

(d). Connect the retriever device 44 to the packer unit 1, through the fishing connector 47, which is coupled to the release connection element 4

(e). Lift the rods string 51 and an internal displacement of inner mandrel 50 of the retriever device is generated which ensures a secure connection with the packer unit through a fishing connector 47.

(f). Tension rods string 51 to shear the first breakout pins; 17*a*, 17*b*, 17*c*, 17*d*, of packer unit 1, which causes the system and/or anchoring and seal elements to relax (The system is retracted); the lower safety retainer 7, the sealing element 8, the upper compression element 9, the anchor element 10, and the lower compression element 11, occurring a separation between the anchor and seal elements with the internal walls of the production pipe.

(g) Remove rods string 51 to surface with retriever device 44, packer unit 1, and BHA that could include: PCP pump, anti-torque anchor 53, perforated pipe 54, and blind plug.

The invention claimed is:

1. A packer system for use wells B in wells, which consisting of: a packer unit, a settling device, to settle the packer unit in the wells, and a retriever device to recover the packer unit from the well, thereby converting a production pipe system in an insertable production system, maintaining production levels while reducing operating times and costs, where the packer unit settles due to an effect of a hydraulic pressure that induces a mechanical displacement towards packer's mobile components by means of the settling device, said packer unit consisting of; a first mandrel, a safety ring, a release connection element, an upper safety retainer, a seal holder, a lower safety retainer, a sealing element, an upper compression element, an anchor element, a lower compression element, an anti-friction ring, an anti-friction retainer, a lower connector, a set of first security pins, a set of second security pins, a set of first breakout pins, a set of second breakout pins to hold the first mandrel to a connection release point and the lower safety retainer, a set of O-rings seals, and at least one Allen stud, wherein;

said mobile components of the packer unit consisting of; the upper safety retainer, the safety ring, the lower safety retainer, the sealing element, the upper compression element and the lower compression element, and these said-moving elements are activated by an induction effect of hydraulic pressure in displacement mechanically towards the mobile components of the packer unit, achieving fixing and sealing to a production pipe;

said at least one Allen stud does not have a function of breaking during the operation of the system, its function is to allow a fixation between the lower compression element and an antifriction element, the second breakout pins set hold the first mandrel to the connection release point and the lower safety retainer, the sealing element maintains the seal between a well pipe and a packer, the safety ring keeps an anchoring system and the sealing element fixed, guaranteeing hermetic sealing in a production pipeline, wherein said anchoring system comprises; the anchor element, the upper compression element and the lower compression element, the anchor element allows anchoring between a production pipe and the packer unit at a programmed depth, the first mandrel provides internal support to the packer unit, in particular in relation to the sealing element, the seal holder, the lower safety retainer, the upper compression element, and the lower compression element of the packer unit respectively, and the anchor element, the release connection element has a release mechanism which, when positioned with the retrieval device, enables an internal release mechanism to be activated and can retrieve the packer unit, the upper safety retainer in conjunction with the safety ring allows a settle of the nchor element and the packer unit sealed, through the displacement of an assembly due to an internal movement of the settling device due to the hydraulic pressure exerted in the well, received directly in an upper cup and in a lower cup, the seal holder allows internal sealing between the first mandrel and the seal holder itself, in addition to being a support for the sealing element, a pair of O-rings is provided between the first mandrel and the seal holder, the lower safety retainer in conjunction with the upper safety retainer, allows the movement of the anchor element and the sealing element, the lower safety retainer has a thread that will be screwed together with the upper safety retainer, the upper compression element and the lower compression element activate the anchoring system to anchor the packer unit, the lower compression element has holes to allow the second security pins set, the anti-friction ring prevents or minimizes friction between the anti-friction retainer and the lower connector, the anti-friction retainer holds fixed the anti-friction ring and the lower connector, the lower connector, connects the packer unit to a stator of a conventional PCP and allows to avoid a backspin effect, the set of first security pins and the set of second security pins are not designed to break, they only function is as a guide for the upper compression element and the lower compression element, and also to support and guide the anchor element, and also connect the anchor element to the upper compression element, the set of second security pins connect the anchor element to the lower compression element, the set of first breakout pins connect the release connection element to the first mandrel, and, the O-rings set are seals to prevent packer unit internal leakage.

2. The packer system according to claim 1, where the settling device consisting of; an upper connector, a piston, a piston seat, a seat holder, a second mandrel, a cup holder sleeve, a pair of cups; upper cup, lower cup, an upper cup holder connector, a lower cup holder connector, a release pin holder, a packer holding connector, a clamp connector retainer, a packer's seal test cup, test cup retainer, a set of release pins, a set of O-rings, wherein;

the upper connector allows connection to a rods string, the piston is a metal-to-metal sealing element, the piston seat to retain the set of O-rings, the seat holder serves as a receptacle for the piston seat and the piston, the second mandrel allows the connection of the piston seat holder to the packer holding connector, as well as serving as a support for the cup holder sleeve, the pair of cups, the O-ring's, the upper cup holder connector, the lower cup holder connector, and the release pin holder, the cup holder sleeve keeps the upper cup connected to the upper cup holder connector, also keeps the lower cup connected to the lower cup holder connector, the upper cup and lower cup are double-acting sealing elements between a well pipeline and the settling device, the upper cup at an external lower end has a groove to put a single O-ring, the lower cup at the external lower end has a groove to put a single O-ring, the upper cup holder connector has an internal profile for coupling to the upper cup, and supports said upper cup, the lower cup holder connector has an internal profile for coupling to the lower cup, and supports said lower cup, the release pin holder holds the release pins and has a plurality of radially equidistant through holes, that installed match with other packer's elements and can be linked by said release pins, the packer holding connector is the connection point between the settling device and the packer, also has an internal threaded at upper region to connect to the second mandrel, and has an intermediate surface region with a diameter less than the packer holding connector's upper and lower region, for that lower end can be used as stop with the release connection point, the clamp connector retainer holds the packer holding connector secure during the packer unit run, and has a plurality of through holes for evacuate fluid from the settling device to the wells when the settling device is extracted;

the packer's seal test cup creates a necessary seal to prevent fluid flow into the well and test the packer unit seal, said packer's seal test cup is a hollow cylinder, and at an internal lower end has a pair of grooves, at a lowest groove is placed a single O-ring, the test cup retainer has an internal profile for coupling to the packer's seal test cup and holds said packer's seal test cup, the set of release pins keep the settling device fixed to the packer unit, until they are sheared due to an applied pressure, said release pins, are configured to break, due to the hydraulic pressure, after the packer is settled, to release the settling device these release pins fix the release pin holder with the lower cup holder connector, the set of O-rings are configured to prevent internal leakage from the settling device.

3. The packer system according to claim 2, wherein the release pin holder has six radially equidistant through holes.

4. The packer system according to claim 2, wherein the set of O-rings is made from polymeric material.

5. The packer system according to claim 2, wherein; the upper connector, the piston, the piston seat, the seat holder, the second mandrel, the cup holder sleeve, the upper cup holder connector, the lower cup holder connector, the release pin holder, the packer holding connector, the clamp connector retainer, the packer's seal test cup, the test cup retainer, are made from any of the following selected steels; SAE/AISI 1030, 1035, 1040, 1045, 1050, 1060, 1095, 4130, 4140, 4340.

6. The packer system according to claim 1, where the retriever device consisting of; an upper stop, a holder for security pins set, a fishing connector, a security pins set, a security ring, an inner mandrel, and a release mechanism, wherein the upper stop connects to a rod string by threading, and allows to transmit weight on the fishing connector, and also tension to extract and/or recover the packer unit with a pumping system, wherein: the upper stop connects to the rod string by threading, and allows to transmit weight on the fishing connector, and also tension to extract and/or recover the packer unit with the pumping system, the holder for security pins set allows to fix the security pins set to the fishing connector, the fishing connector allows the retriever device and packer unit to be connected to the internal profile of the release connection element, said fishing connector is a hollow cylinder with three radial surface regions, each one with different diameters, oriented from down to up, the fishing connector comprise a first radial toothed region, a second radial surface region, and a third radial surface region, the first radial toothed region has approximately a same diameter than the second radial surface region, but both less than the third radial surface region, the third radial surface region has six through holes equidistant radially spaced to insert said security pins set, the security pins set are threaded that allows a union between the fishing connector and the holder for security pins set, said security pins set are designed to break off in tension, in an event of release system failure, binding, or problems recovering the packer unit, the security ring consists of two clamping shells complementary, whose function is to prevent the displacement of the upper stop, the inner mandrel facilitates connection to the rod string and supports the fishing connector, said inner mandrel has four radial regions, oriented down to up, has a first radial region that is a head, next a second radial region that is a neck, next there is a third radial region that is a shoulder, and follow a fourth radial region is an elongated body, the head is adjusted internally with first radial toothed surface region of the fishing connector, the neck has a diameter less than the head, the shoulder is a stopper between said inner mandrel, and said holder for security pins set, and has approximately the same diameter than the head, on the elongated body has a groove to place the security ring, the release mechanism consists of the connection of the fishing connector with the release connection point, then the movement upwards by an action of the tension of the rod string allows the inner mandrel to be coupled inside of the fishing connector.

7. The packer system according to claim 6, wherein; the upper stop, the holder for security pins, the fishing connector, the two clamping shells, the inner mandrel, are made from any of the following selected steels; SAE/AISI 1030, 1035, 1040, 1045, 1050, 1060, 1095, 4130, 4140, 4340.

8. The packer system according to claim 6, wherein the security pins set from are made of any of the following selected materials; B505-C854, B505-C844, B505-C932, SAE-660.

9. The packer system of claim 1, wherein-the-further comprising a number of Allen studs is between one to six.

10. The packer system of claim 1, wherein a number of the second breakout pins set is between one to eight.

11. The packer system of claim 1, wherein said sealing element is made from polymeric material.

12. The packer system according to claim 1, wherein the O-rings set is made from a polymeric material.

13. The packer system according to claim 1, wherein; the safety ring, the anchor element, the first mandrel, the release connection element, the upper safety retainer, the seal holder, the lower safety retainer, the upper compression element, the lower compression element, the anti-friction ring, the anti-friction retainer, the lower connector, the set of first security pins, the set of second security pins, are made from any of the following selected steels; SAE/AISI 1030, 1035, 1040, 1045, 1050, 1060, 1095, 4130, 4140, 4340.

14. The packer system according to claim 1, wherein; the set of first breakout pins and the second breakout pins set are made from any of the following selected materials; B505-C854, B505-C844, B505-C932, SAE-660.

15. A process to settle a Packer in well, by executing the following steps:

supplying a packer unit as described in claim 1, a settling device a rod string, a progressive cavity pump stator and rotor, a calibration tool, a BOP's rams, a blind plug, a perforated pipe, and an anti-torque anchor-;

retrieving the rod string with a PCP rotor;

supplying a calibration tool with a known external diameter, according to an internal diameter of a tubing, greater than the external diameter of the packer unit for calibration;

calibrating a production pipe where the packer unit will be installed;

descending the rod string, with calibration assembly to target depth;

filling a production tubing according to capacity, until a surface return is observed;

closing the BOP and testing the production pipe at a predetermined pressure between 380 to 3800 psi;

pulling out the rod string with the calibration tool to surface;

assembling and calibrating BHA, the blind plug, the perforated pipe, the anti-torque anchor, and a BCP stator with the packer unit;

connecting the settling device and the packer unit set to the PCP stator;

continuing the rod string run until a programmed depth is reached;

recording the rod string with a weight of the BHA at the programmed depth, this is neutral weight going up and down;

filling the production tubing with control fluid, until the return is observed on the surface;

closing the BOP's rams to make settling, and relaunching to pressure increase, up to the pressure calculated in a pre-operational meeting;

closing a piston valve when a predetermined pressure is reached;

inserting a piston, a piston seat, and a seat holder;

as a result of the pressure exerted by a hydrostatic column and the pump on the surface, a mechanical displacement occurs at an upper cup and a lower cup; shearing the packer's breakout pins, to start a settlement process, and generating an external displacement that contracts the sealing element and the anchoring element, and consequently, an expansion of said elements towards internal walls of the production pipe, generating anchoring and seal;

opening the BOP's rams and applying a predetermined force of approximately between 3000 to 6000 lbs of weight and tension to verify the seating of packer unit;

the BOP's rams to proceed to release the settling device, reaching the pressure already calculated in the pre-operational meeting, the increase in pressure generates an internal rupture due to shearing of the release pins, which leaves the mechanism free and generates a disengagement the second mandrel, releasing the packer holding connector;

(releasing pressure from the system, open the BOP's rams and remove the rod string with settling device to surface; and assembling the PCP rotor and the rod string and calibrating the PCP rotor and running in with the rod string, and testing the PCP.

16. The process to settle a packer according to claim 15, wherein the predetermined pressure is 500 Psi.

17. The process to settle a packer according to claim 15, wherein the predetermined force is 4000 pounds of weight and tension.

18. A process to retrieve a packer unit in a well, by executing the following steps:

supplying a packer unit as described in claim 15, a retriever device a rod string, a tubular progressive cavity pump (PCP), an anti-torque anchor, a perforated pipe, a blind plug, and a pump rotor of progressive cavity (PCP);

extracting the rod string with a PCP rotor;

assembling the retriever device and the rod string and running down in a BHA, until locating the packer unit;

connecting the retriever device to the packer unit, through a fishing connector, which is coupled to the release connection element;

lifting the rod string until an internal displacement of an inner mandrel of the retriever device is generated to connect with the packer unit;

applying tension to the rod string to shear the first breakout pins of the packer unit, which causes one or more of a system or of an anchor element and a seal element to relax;

the lower safety retainer, the sealing element, the upper compression element, the anchor element, and the lower compression element, allowing a separation between the anchor element and the seal element with an internal wall of the production pipe; and removing the rod string to surface with the retriever device, the packer unit, and the BHA.

19. The process to claim 18, wherein the inner mandrel ensures a secure connection with the packer unit through the fishing connector of the retriever device.

* * * * *